US006775880B2

(12) United States Patent
Kasper et al.

(10) Patent No.: US 6,775,880 B2
(45) Date of Patent: Aug. 17, 2004

(54) PROTECTANT APPLICATION

(75) Inventors: Gary A. Kasper, Grand Rapids, MI (US); Samuel N. Hansen, Jenison, MI (US); John L. Jansen, Midlevels (HK); Phong Hoang Tran, Caledonia, MI (US); Eric J. Hansen, Ada, MI (US); Gabriel S. Vander Baan, Grand Rapids, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 0 days.

(21) Appl. No.: 10/042,603

(22) Filed: Jan. 9, 2002

(65) Prior Publication Data

US 2002/0092117 A1 Jul. 18, 2002

Related U.S. Application Data

(60) Provisional application No. 60/262,154, filed on Jan. 17, 2001, and provisional application No. 60/285,179, filed on Apr. 20, 2001.

(51) Int. Cl.[7] ..... A47L 11/30
(52) U.S. Cl. ..... 15/321; 15/322
(58) Field of Search ..... 15/320, 321, 322

(56) References Cited

U.S. PATENT DOCUMENTS

| | | | | |
|---|---|---|---|---|
| 2,270,579 A | | 1/1942 | Chamberlain et al. | |
| 3,208,639 A | | 9/1965 | Marwell et al. | |
| 4,114,229 A | | 9/1978 | Jones et al. | 15/320 |
| 4,218,900 A | | 8/1980 | Caplan et al. | 15/322 |
| 4,333,203 A | | 6/1982 | Yonkers | 15/321 |
| 4,458,377 A | | 7/1984 | Frohbieter | 15/320 |
| 4,485,518 A | | 12/1984 | Kasper | 15/322 |
| 4,558,823 A | | 12/1985 | Groth | 239/413 |
| 4,676,287 A | | 6/1987 | Fitzwater | 141/285 |
| 4,829,624 A | | 5/1989 | Grzywna et al. | 15/320 |
| 4,854,544 A | | 8/1989 | Blase et al. | 251/245 |
| 5,059,420 A | * | 10/1991 | Scholla et al. | 514/705 |
| 5,180,439 A | | 1/1993 | Allison | 15/322 |
| 5,299,608 A | | 4/1994 | Bosyj | 15/320 |
| 5,738,687 A | * | 4/1998 | Kamrath et al. | 8/115.56 |
| 5,884,679 A | | 3/1999 | Hansen et al. | 141/386 |
| 5,983,442 A | | 11/1999 | Louis et al. | 15/320 |
| 6,041,472 A | | 3/2000 | Kasen et al. | 15/355 |
| 6,081,962 A | | 7/2000 | Kasen et al. | 15/353 |
| 6,116,798 A | | 9/2000 | Chen et al. | 401/42 |
| 6,376,542 B1 | * | 4/2002 | Hansen et al. | 514/544 |

FOREIGN PATENT DOCUMENTS

| | | |
|---|---|---|
| EP | 0 278 632 | 8/1988 |
| GB | 2334668 A | 9/1999 |

* cited by examiner

*Primary Examiner*—Theresa T. Snider
(74) *Attorney, Agent, or Firm*—McGarry Bair PC

(57) ABSTRACT

A hand-held nozzle is attached to the end of a vacuum and fluid delivery hose of an upright deep cleaner. The nozzle includes a reservoir to contain a solution to be applied to a surface. When a solution delivery system of the deep cleaner is pressurized, water from the upright cleaner clean water tank is routed through the hose to the hand-held nozzle. The water is routed through a venturi valve connected to the reservoir, which draws the solution to the valve to mix with the water stream. The resultant mixture flows from the hand-held nozzle for application to a surface being treated. One embodiment of the solution reservoir includes a retainer cap bonded to the reservoir and utilizing a bayonet-type mounting arrangement for mounting the reservoir to a nozzle assembly.

22 Claims, 19 Drawing Sheets

PROTECTANT APPLICATION

CROSS-REFERENCE TO RELATED APPLICATIONS

This application claims the benefit of U.S. provisional application No. 60/262,154 filed Jan. 17, 2001, and U.S. provisional application No. 60/285,179 filed Apr. 20, 2001.

BACKGROUND OF THE INVENTION

1. Field of the Invention

The invention relates to protectant application to carpets and fabrics. In one of its aspects, the invention relates to a hand-held nozzle attachment for an upright deep cleaner or extractor. In another of its aspects, the invention relates to an upright deep cleaner or extractor with spray applicator for applying a solution, such as stain repellant or other treatment, to a surface. In another of its aspects, the invention relates to a method for applying a liquid protectant to a carpet or fabric surface.

2. Description of the Related Art

Upright deep cleaners or extractors are disclosed in U.S. Pat. Nos. 6,041,472 and 6,081,962. These prior art upright deep cleaners include an above-floor cleaning nozzle fluidly connected to the cleaner by vacuum and fluid delivery conduits, for applying a cleaning solution to an above-floor surface being cleaned and for extracting fluid from the surface being cleaned after application of the cleaning solution. The cleaning solution applied to the surface being cleaned is generally a mixture of water and a detergent. The mixture is either combined in a mixing valve in the body of the deep cleaner or in a clean solution tank of the deep cleaner. The solution is then pumped through the fluid delivery conduit either to the floor or to an above-floor surface being cleaned. The operator of the upright deep cleaner also has the option of omitting the detergent solution so that only water is pumped through the fluid delivery conduit.

After deep cleaning of a floor or above-floor surface with a deep cleaner, such as an upright deep cleaner, it is desirable in many cases to apply or refresh a protective coating, such as a stain repellant or other treatment, to the surface cleaned. Scotchgard™ by 3M™ is one such known treatment. Prior art devices, separate from the upright deep cleaner, are known for this purpose.

It would be advantageous to remove the requirement for a separate protectant-applying machine and take advantage of the capabilities of the upright deep cleaner that is already in use, and already at the location of the surface to be treated, to apply a protectant or other treatment to the cleaned surface.

SUMMARY OF THE INVENTION

According to the invention, a portable surface cleaning apparatus comprises a base housing adapted for movement along a surface to be cleaned, an upright handle pivotally mounted to the base housing, a liquid dispensing system mounted at least in part to the base housing and including a fluid supply tank, a liquid recovery system including an above-floor hose fluidly connected at one end to a recovery tank and having an open end, the above-floor hose carrying a liquid supply conduit and mounting an above-floor liquid dispenser including a spray nozzle at the open end thereof. According to the invention, a fluid reservoir is mounted to the above-floor liquid dispenser for dispensing a fluid onto a surface and a fluid reservoir pump is mounted to the above-floor liquid dispenser for drawing fluid from the reservoir and for spraying the fluid onto the surface along with fluid from the liquid supply tank.

The liquid dispensing system typically can be the type that includes a floor liquid dispenser associated with the base housing for applying liquid to a floor surface to be cleaned, a liquid supply tank for holding a supply of cleaning liquid, a liquid supply conduit fluidly connected to the liquid supply tank and to a floor liquid dispenser for supplying a cleaning fluid to the floor dispenser.

The liquid recovery system is typically of the type that includes a recovery tank mounted on the base housing and having a liquid recovery chamber for holding recovered liquid, a suction nozzle associated with the base housing and adapted to draw dirty liquid from the surface to be cleaned, a working air conduit extending between the recovery chamber and the suction nozzle and a vacuum source in fluid communication with the recovery chamber for generating a flow of working air from the nozzle through the working air conduit, or alternatively from the open end of the above-floor hose, and through the recovery chamber to thereby draw dirty liquid from the surface to be cleaned through the nozzle and working air conduit, or from the open end of the above-floor hose and into the recovery chamber to thereby recover the dirty liquid from the surface to be cleaned.

In one embodiment, the liquid recovery system further comprises a switch for selectively operating the vacuum source independent of the pump.

Preferably, the fluid reservoir pump is an aspirator. Further, the above-floor liquid dispenser is without a suction nozzle opening and preferably has a vent opening for venting suction in the hose to the atmosphere.

In a preferred embodiment, the above-floor liquid dispenser and the reservoir have a quick connect mechanism for removably mounting the reservoir to the second liquid dispenser. The quick connect mechanism includes an open neck on an upper portion of the reservoir. Further, a cap is adapted to mount to the open neck of the reservoir when the reservoir is removed from the above-floor liquid dispenser for sealing the reservoir when the reservoir is removed from the above-floor liquid dispenser. In one embodiment, the neck is threaded and the cap is threaded onto the neck. Further, the reservoir is vented through the threads on the neck. The quick connect can take a number of different forms and in a preferred embodiment is a bayonet connection.

The invention is designed to spray a liquid surface protectant composition onto a carpet or fabric surface. To this end, a body of a liquid surface protectant composition is in the reservoir. The liquid surface protectant can be a liquid stain repellent composition or a liquid miticide composition.

Further according to the invention, a spray applicator for attachment to a portable surface cleaning apparatus having a combination vacuum hose and fluid delivery conduit comprises a unitary body having a suction opening at one end adapted to mount to an open end of the vacuum hose and further having a nozzle pressure conduit that is adapted to fluidly connect to a fluid delivery conduit at one end thereof, a reservoir mounted to the unitary body, a spray nozzle connected to another end of the nozzle pressure conduit, and a fluid reservoir pump in the nozzle pressure conduit and connected to the reservoir for drawing fluid from the reservoir and mixing the reservoir fluid with liquid in the nozzle pressure conduit for spraying a mixture of fluid from the reservoir and fluid from the fluid delivery line onto a surface.

The unitary body preferably includes a vent connected to the suction opening for venting suction in the vacuum hose to atmosphere and is void of a suction nozzle. In a preferred embodiment, the fluid reservoir pump is an aspirator.

A body of liquid protectant is within the reservoir. The liquid protectant can be a liquid stain repellent composition or a liquid miticide composition.

The unitary body and the reservoir have a quick connect mechanism for removably mounting the reservoir to the second liquid dispenser. In a preferred embodiment, the quick connect mechanism includes an open neck on an upper portion of the reservoir and the quick connect is a bayonet connection. Further, a cap is adapted to mount to the open neck of the reservoir when the reservoir is removed from the second liquid dispenser for sealing the reservoir when the reservoir is removed from the second liquid dispenser. Desirably, the neck is threaded and the cap is threaded onto the neck. Further, the reservoir is vented through the threads on the neck.

The reservoir can take a number of different shapes. In one embodiment, the reservoir has a generally cylindrical sidewall, a bottom wall and a top wall. A portion of the bottom wall extends at an acute angle to the side wall at a position beneath the spray nozzle. Preferably, the acute angle is in the range of about 30 to 60 degrees. In a specific embodiment, the acute angle is about 45 degrees.

Still further according to the invention, a portable surface cleaning apparatus has a housing, a first tank connected to the housing has a body of a liquid protectant composition therein, a second tank mounted to the housing has a body of water therein, and a spray nozzle in fluid communication with each of the first and second tanks for applying a mixture of the liquid protectant and water to a surface. Preferably, a fluid delivery system has an inlet in fluid communication with each of the first and second tanks and an outlet in fluid communication with the spray nozzle spray nozzle for delivering the mixture of protectant and water to the spray nozzle for spraying a mixture of the liquid protectant and water onto the surface to be treated. In one embodiment of the invention, the fluid delivery system is an aspirator In a preferred embodiment, a mixing valve has a pair of inlets in fluid communication with each of the first and second tanks and an outlet in fluid communication with the fluid delivery system. In one embodiment, the mixing valve is selectively adjustable to control the relevant amount of protectant composition in the mixture delivered to the spray nozzle.

The protectant composition can be a stain repellant, a miticide composition or a mildew repellant, or any mixture thereof.

In one embodiment, the first tank is connected to the housing through a suction hose. In another embodiment of the invention, the first tank is mounted on the housing. In the latter embodiment, the fluid delivery system includes a pump that is mounted on the housing and supplies water under pressure to the spray nozzle.

The portable surface cleaning apparatus according to one embodiment of the invention is the type that has a fluid recovery system which includes a suction nozzle mounted to the housing, a recovery tank mounted to the housing, a working air conduit extending between the recovery chamber and the suction nozzle; and a vacuum source in fluid communication with the recovery tank for generating a flow of working air from the nozzle through the working air conduit and through the recovery chamber to thereby draw dirty liquid from the surface to be cleaned through the nozzle and working air conduit and into the recovery tank.

Still further according to the invention a method of applying a liquid protectant solution to a surface comprises the steps of:

placing the liquid protectant solution into a dispensing tank in an extraction cleaning machine which includes the dispensing tank, a dispenser for applying a fluid to a surface to be cleaned in fluid communication with the dispensing tank, and wherein the extraction cleaning machine further includes a liquid recovery system for recovering soiled liquid from a surface on which a liquid cleaning solution had been applied; and dispensing the liquid protectant solution in the dispensing tank onto the surface through the dispenser as the extraction cleaning machine is moved over the surface.

Preferably, the liquid protectant solution is applied to a carpeted floor. The liquid protectant solution is preferably a liquid stain, mildew repellent composition, a miticide composition or mixtures thereof.

In one embodiment, the method of applying a liquid protectant solution to a surface further comprises the step of disabling the liquid recovery system prior to the dispensing step. Preferably, the dispensing step comprises spraying. In one embodiment, the dispensing step includes pumping the liquid protectant solution under pressure to the dispenser.

In yet another embodiment of the invention, a portable surface cleaning apparatus comprises a base housing adapted for movement along a surface to be cleaned, an upright handle pivotally mounted to the base housing, a liquid dispensing system mounted at least in part to the base housing and a liquid recovery system. The liquid dispensing system includes a liquid dispenser associated with the base housing for applying liquid to a surface to be cleaned, a liquid supply tank with a body of a liquid protectant solution and connected to the liquid dispenser for supplying the liquid protectant solution to the liquid dispenser; and a fluid pump for delivering the liquid protectant solution from the liquid supply tank to the liquid dispenser.

The liquid recovery system comprises a recovery tank mounted on the base housing and having a liquid recovery chamber for holding recovered liquid, a suction nozzle associated with the base housing and adapted to draw dirty liquid from the surface to be cleaned, a working air conduit extending between the recovery chamber and the suction nozzle and a vacuum source in fluid communication with the recovery chamber for generating a flow of working air from the nozzle through the working air conduit through the recovery chamber to thereby draw dirty liquid from the surface to be cleaned through the nozzle and working air conduit, and into the recovery chamber to thereby recover the dirty liquid from the surface to be cleaned.

DESCRIPTION OF THE PREFERRED EMBODIMENT

Figure 1:
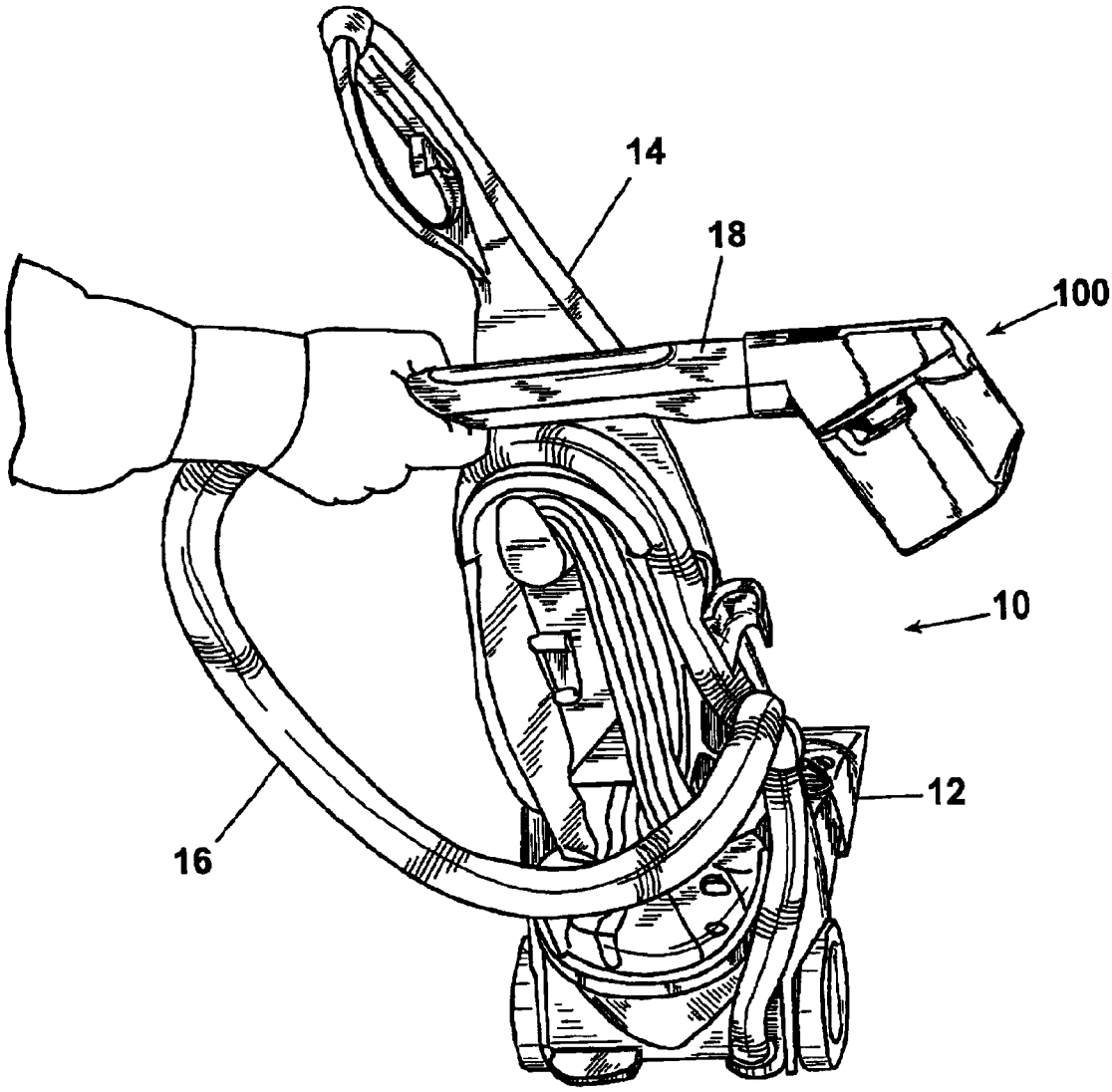
FIG. 1 is a spray applicator according to the invention attached to an upright deep cleaner.

Referring to the drawings and to FIG. 1 in particular, an upright deep cleaner 10 has a floor-traveling head 12 with wheels and a floor suction nozzle (not shown) and an upright handle 14, pivotally mounted to the floor-traveling head 12. An above-floor cleaning hose 16 includes vacuum and fluid delivery conduits connected to deep cleaner 10 at one end and to a handle 18 of the hose 16 at another end. Accessory tools can be removably mounted onto the handle for selectively cleaning above-floor surfaces, such as upholstery. The deep cleaner has a fluid delivery system, including a cleaning fluid or clean water tank, a pump and a spray nozzle on the floor-traveling head 12 to spray cleaning fluid onto the floor. The deep cleaner further includes a vacuum source, typically a motor and an impeller to draw suction on the floor nozzle and a recovery tank connected to the nozzle and to the vacuum source, typically between the two, to collect soiled liquid recovered from the floor nozzle. A conversion device or valve selectively connects the above-floor hose 16 with the vacuum source and with the spray pump for above-floor cleaning. Deep cleaners of this nature are well known and are disclosed more completely in U.S. Pat. Nos. 6,041,472 and 6,081,962, which are both incorporated herein by reference.

According to the invention, a spray applicator 100 is mounted to the handle 18 in lieu of an above-floor cleaning tool for selectively spraying onto a floor or upholstery surface a liquid, such as a protectant, stain repellant, and/or other treatment. The treatment can include oxygen bleaching formulas, or one of numerous known solvent/water based miticides, fungicides or mildewcides, to help achieve a cleaner, more protected and/or lower allergen containing home environment. The material of the spray applicator is preferably a polyethylene or a polypropylene, as these provide maximum chemical compatibility. The spray applicator 100 connects to the fluid delivery system of the deep cleaner 10 to spray a liquid onto the floor when the deep cleaner 10 is converted to the above-floor mode. To this end, the spray applicator has a solution reservoir for the protectant and a venturi or other suction device to mix the protectant with the water from the fluid delivery system and spray the mixture on the floor or other surface to be treated.

Figure 2:
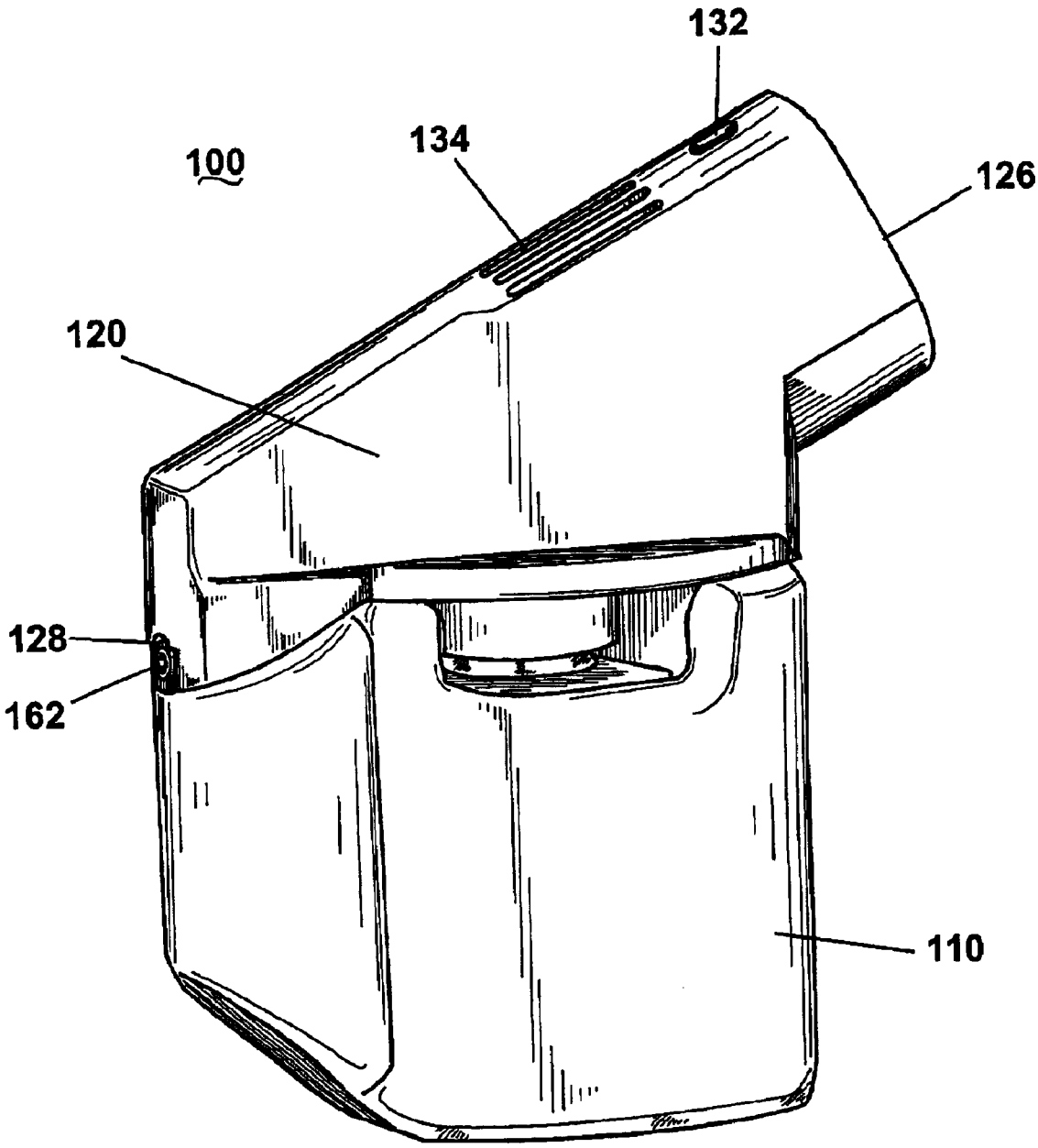
FIG. 2 is a perspective view of the spray applicator of FIG. 1.

Referring now to FIG. 2, the spray applicator 100 comprises a solution reservoir 110 for holding a liquid solution such as a protectant or stain repellant. A nozzle assembly 120 is assembled to the solution reservoir 110 in a removable fashion, the nozzle assembly 120 being fluidly connected to the solution reservoir 110. The nozzle assembly 120 includes an opening 126 for mounting of the spray applicator 100 to the above-floor handle 18 of the upright deep cleaner 10. The nozzle assembly 120 also includes a vent opening 134 which vents the suction in the hose 16 from the vacuum source in the deep cleaner 10. In some known deep cleaners, the vacuum source is selectively operable independent of other power-operated systems of the deep cleaner, such as a solution pump. A spray applicator 100 for use with such a deep cleaner can omit vent opening 134. The spray applicator 100 is attached at the opening 126 to the above-floor attachment handle 18 in a removable fashion, a resiliently mounted projection (not shown) of the above-floor attachment handle 18 acting as a detent in a retention aperture 132 of the nozzle assembly 120. A nozzle opening 128 is at the forward end of the nozzle assembly 120 opposite from the opening 126 for projection of a dispensing nozzle tip 162 therefrom.

Figure 3:
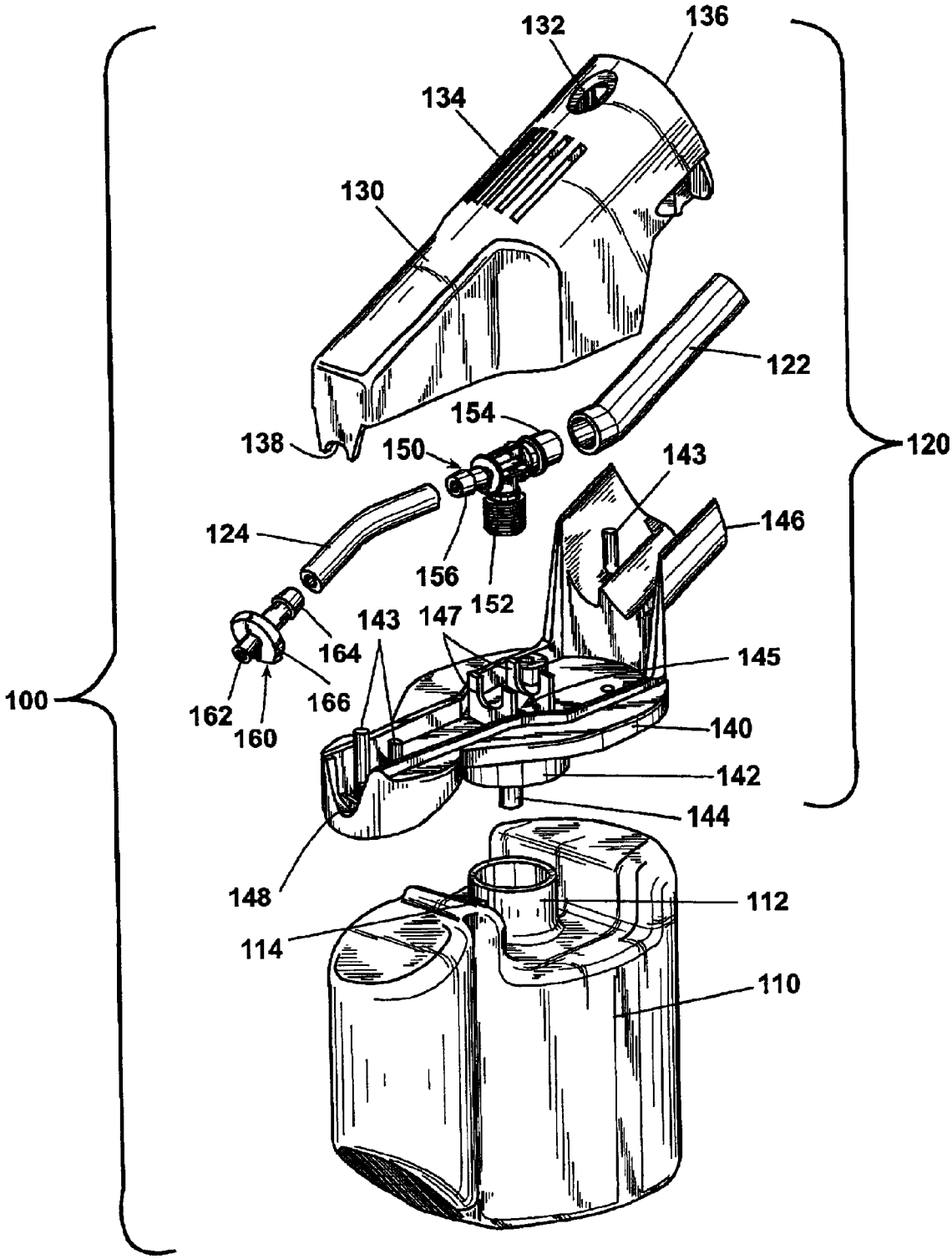
FIG. 3 is an exploded perspective view of the spray applicator of FIGS. 1–2.
Figure 4:
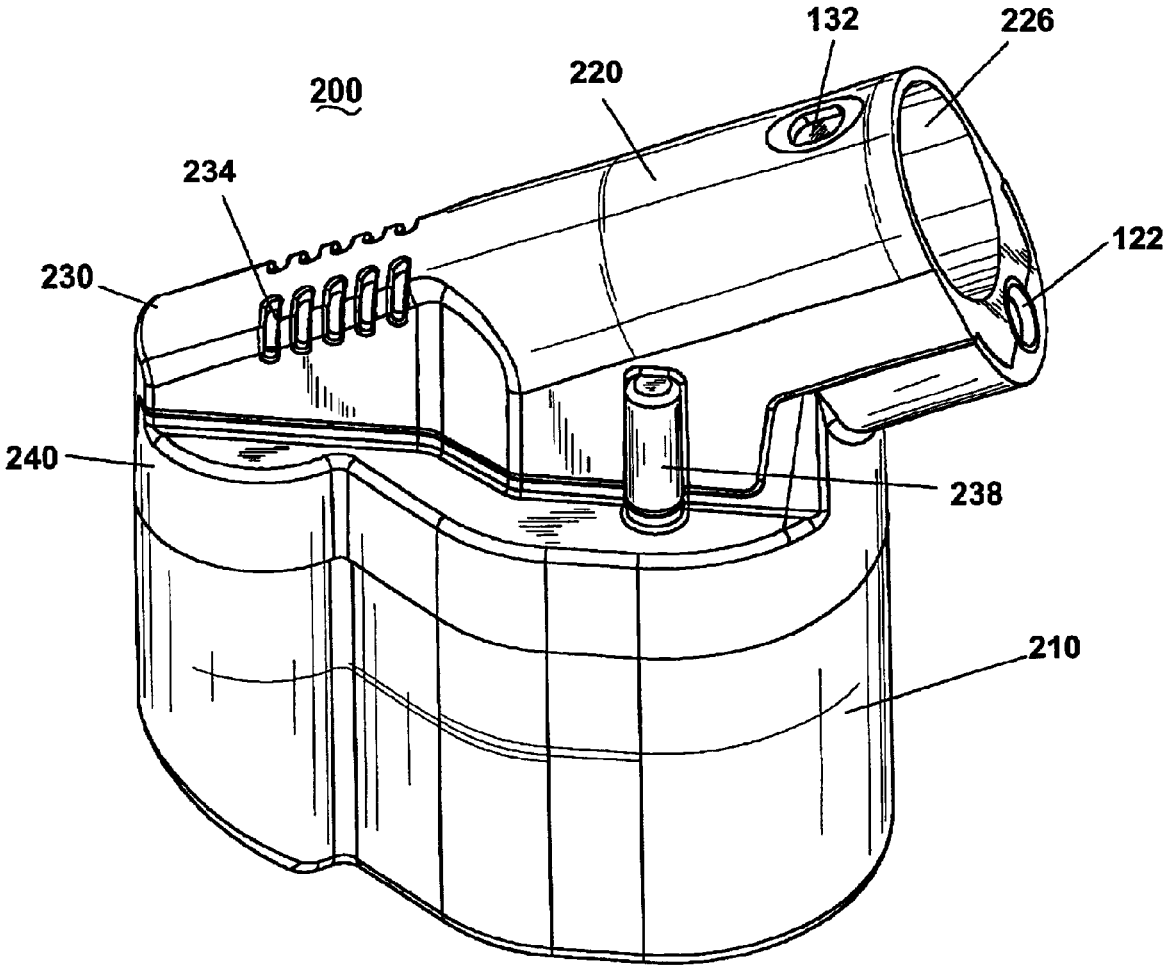
FIG. 4 is a perspective view of a solution reservoir and spray applicator assembly according to a further embodiment of the invention.

Referring now to FIG. 3, the spray applicator 100 according to the invention is shown in exploded form to more definitively show the details of the invention. Solution reservoir 110 includes a reservoir neck 112 for receiving the nozzle assembly 120. Solution reservoir 110 is enclosed except for the reservoir neck 112. The reservoir neck 112 includes a pair lugs 114 projecting outwardly from the surface of the neck 112.

The nozzle assembly 120 as shown in FIG. 3 includes an upper housing 130, a lower housing 140, a water supply tube 122, a nozzle supply tube 124, a venturi 150 and a dispensing nozzle 160. The lower housing 140 includes a first attachment end 146 corresponding to the attachment opening 126 of the overall nozzle assembly 120 and a second dispensing nozzle end 148 corresponding to the nozzle opening 128 of the nozzle assembly 120. The lower housing 140 further includes a solution suction tube fitting 144 depending from the lower housing 140 within a sleeve 142. Sleeve 142 is adapted to connect nozzle assembly 120 to reservoir 110 at reservoir neck 112, such that when the nozzle assembly 120 is assembled to the solution reservoir 110, the solution suction tube fitting 144 lies within the reservoir neck 112 and a solution suction tube (not shown) fluidly connected to the solution suction tube fitting 144 reaches to the bottom of the solution reservoir 110 for fluidly connecting the lower housing 140 to solution at the bottom of the solution reservoir 110. The solution suction tube fitting 144 is further fluidly connected to a venturi-receiving well 145 in the interior of the lower housing 140. Lower housing 140 further includes a number of alignment bosses 143 for aligning lower housing 140 with upper housing 130.

The upper housing 130 of the nozzle assembly 120 includes a first end 136 corresponding to the opening 126, forming the opening 126 in concert with the first end 146 of the lower housing 140 and a second dispensing nozzle opening end 138. The dispensing nozzle end 138 in concert with the dispensing nozzle end 148 of the lower housing 140 forms the nozzle opening 128 of the nozzle assembly 120.

The venturi 150 includes a water supply tube fitting 154, a nozzle supply tube fitting 156 and a solution suction fitting 152. The venturi 150 is inserted in the lower housing 140 so that the solution suction fitting 152 is fluidly and sealingly connected to the solution suction tube fitting 144 and thus the solution within the solution reservoir 110. The solution suction fitting 152 is inserted in the well 145 and includes an outer resilient surface forming a leak-tight seal in the well 145. The venturi 150 is supported by a pair of support cradles 147 in the lower housing 140 and secured in place by corresponding projections (not shown) in the upper housing 130.

The water supply tube fitting 154 is connected to the water supply tube 122. The nozzle supply tube 124 is fluidly connected to the nozzle supply tube fitting 156 of the venturi 150 in the lower housing 140. The nozzle supply tube 124 is further fluidly connected to the nozzle supply tube fitting 164 of the dispensing nozzle 160. The dispensing nozzle 160 is configured to be fixed in the nozzle end 148 of the lower housing 140 so that the dispensing nozzle tip 162 is directed toward the dispensing nozzle opening 128 of the nozzle assembly 120.

The water supply tube 122, fluidly connected to the water supply tube fitting 154 of the venturi 150, is further affixed to the lower housing 140 so that an opposite end of the water supply tube 122 is presented at the opening 126 of the nozzle assembly 120. When the nozzle assembly 120 is attached to the handle 18 of the hose 16, the water supply tube 122 fluidly and sealingly connects to the fluid delivery conduct of the above-floor cleaning hose 16. The water supply tube 122, venturi 150, nozzle supply tube 124 and dispensing nozzle 160 are further mechanically secured by integral projections within the nozzle assembly 120 upon assembly of the upper housing 130 to the lower housing 140. The upper and lower housing 130, 140 are configured and contoured to present a continuous outer surface upon assembly of the nozzle assembly 120.

The assembled nozzle assembly 120, including a solution suction tube (not shown) can then be assembled to the solution reservoir 110 (containing a protectant solution). The lugs 114 cooperate with a ramped groove and slots (see, for example, ramped groove 298 and slot 294 in FIG. 5) on an interior surface of sleeve 142 depending from the nozzle assembly 120 for a bayonet connection. The sleeve 142 is lowered over the reservoir neck 112 with the slots aligning with the lugs 114, with the nozzle assembly 120 aligned at an angle to the left or right of the longitudinal axis of the solution reservoir 110. As the nozzle assembly 120 is rotated to be in alignment with the solution reservoir 110, the ramp on the interior surface of the sleeve 142 draws the nozzle assembly 120 down onto the solution reservoir 110. The end of each ramp engaging the lugs 114 includes a detent portion for engaging the lugs 114 and resisting rotation of the nozzle assembly 120 out of alignment with the solution reservoir 110. The assembled spray applicator 100 is further adapted to connect to the above-floor attachment handle 18 of the above-floor cleaning attachment of the deep cleaner 10. The nozzle assembly 120 can also be attached to the above-floor attachment handle 18 without the solution reservoir, with the solution reservoir 110 being attached thereafter.

Referring now to FIGS. 4–16, a second embodiment of the spray applicator 200 comprises a solution reservoir assembly 210 and a nozzle assembly 220. Spray applicator 200 connects to and operates with the upright deep cleaner 10 in the same fashion as the first embodiment of the spray applicator 100, in that opening 226 and water supply tube 122 are fluidly connected to the above-floor attachment handle 18 of the upright deep cleaner 10, and are held to the handle 18 by a projection on the handle 18 engaging retention aperture 132.

Figure 5:
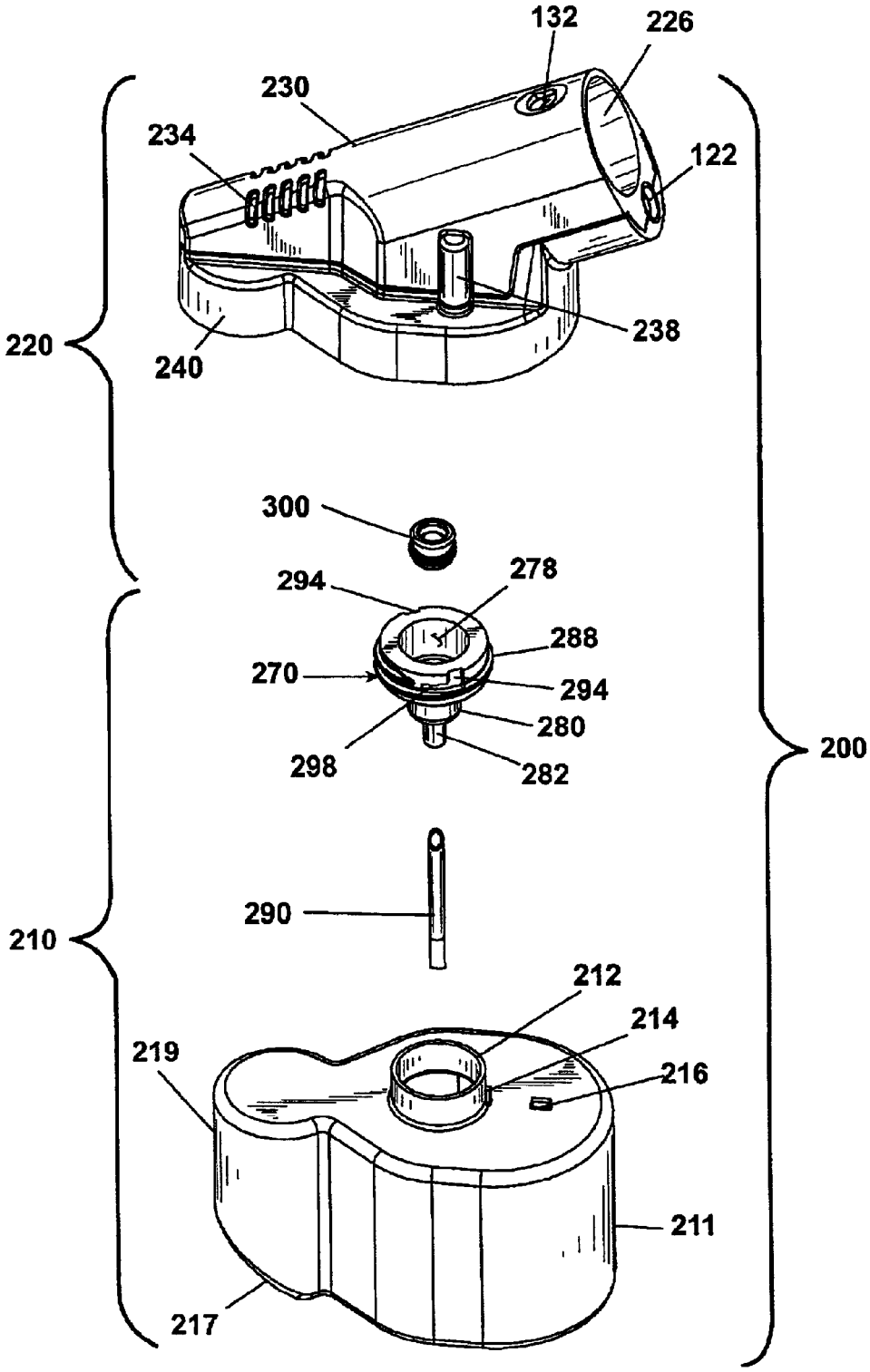
FIG. 5 is an exploded perspective view of the solution reservoir and spray applicator assembly of FIG. 4.

Referring to FIG. 5, the spray applicator 200 comprises the nozzle assembly 220 having upper and lower housings 230, 240 and further comprising a resilient seal 300. Upper housing 230 displays on an outer face thereof bosses 238 having an internal function of aligning and securing upper housing 230 and lower housing 240. Upper housing 230 further includes vent openings 234 for venting suction in the hose 16 from the vacuum source of the cleaner 10. As in the previous embodiment, when used with a deep cleaner having an independently selectively operable suction source, spray applicator 200 can omit vent opening 234. The solution reservoir assembly 210 includes a solution reservoir 211 having a reservoir neck 212, a retainer cap 270 and a siphon tube 290.

Figure 6:
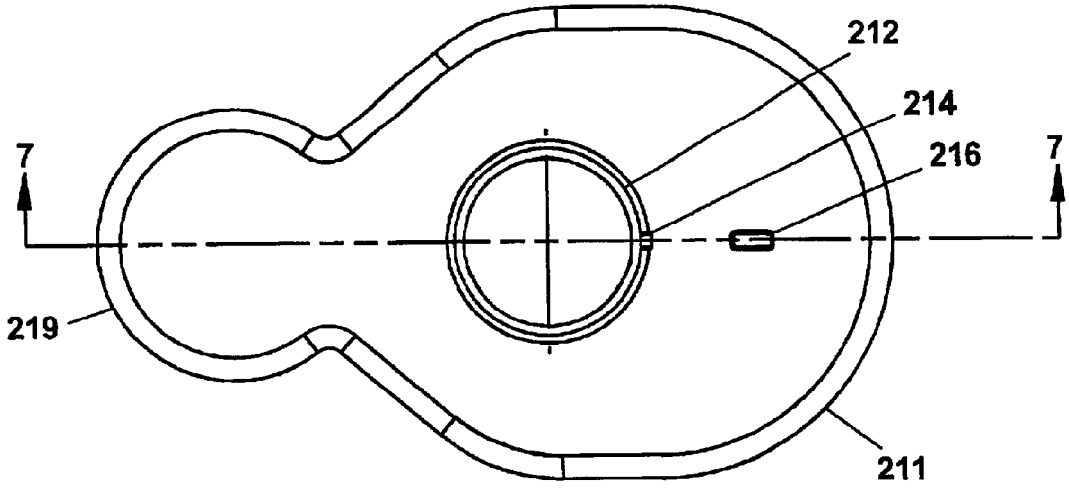
FIG. 6 is a top view of the solution reservoir of FIGS. 4–5.
Figure 7:
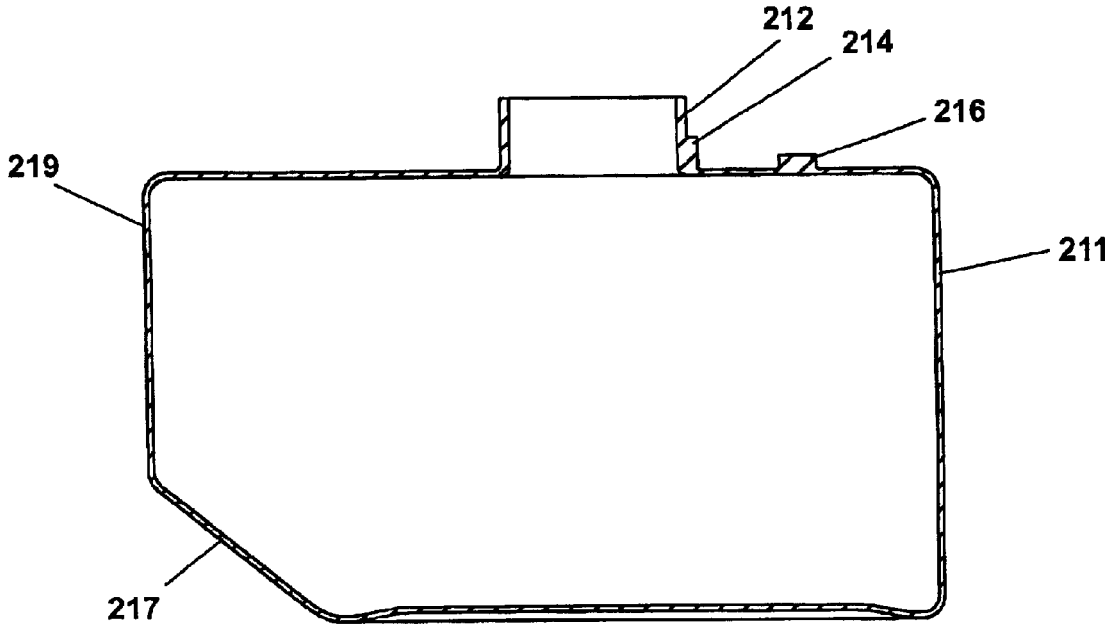
FIG. 7 is a cross-sectional view taken through line 7—7 of FIG. 6.

FIGS. 6 and 7 disclose solution reservoir 211 further including a key 214 projecting from a rear face of reservoir neck 212 on a longitudinal centerline of solution reservoir 211. Solution reservoir 211 further comprises an over-rotation projection 216 projecting from an upper surface of solution reservoir 211 and aligned on a longitudinal centerline. A lower portion 217 of front face 219 of reservoir 211 is truncated, so that when reservoir 211 is directed downwardly during use, lower portion 217 presents an effectively flat bottom of reservoir 211 to siphon tube 290. Reservoir 211 is further configured in plan view to conform to the outline of nozzle assembly 210 (see FIGS. 4, 6 and 14).

Figure 9:
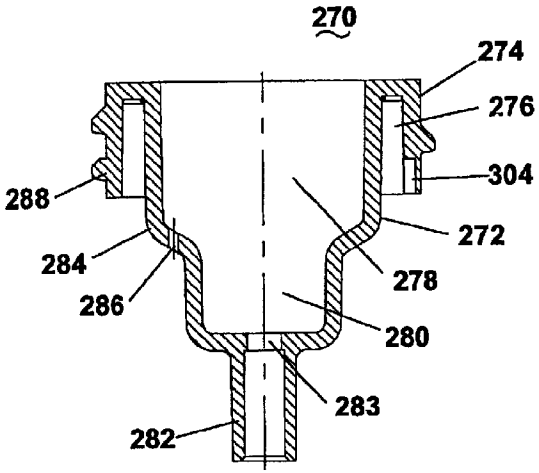
FIG. 9 is a cross-sectional view taken through line 9—9 of FIG. 8.
Figure 10:
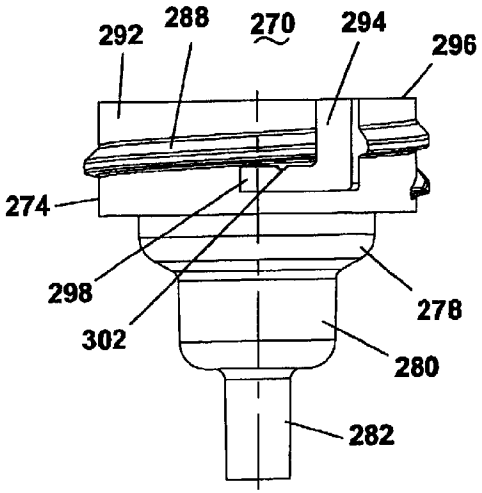
FIG. 10 is a side view of the retainer cap of FIGS. 8–9.
Figure 8:
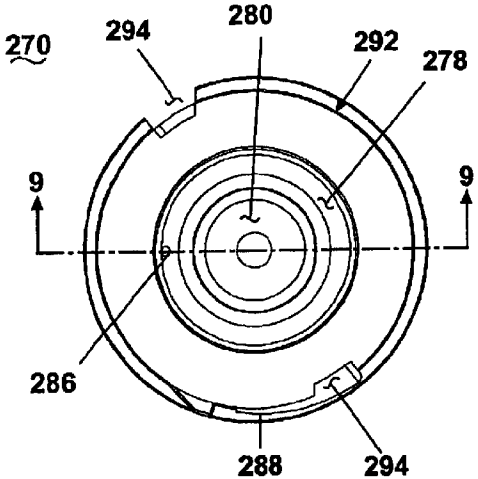
FIG. 8 is a top view of a retainer cap for the solution reservoir of FIGS. 6–7.

Turning now to FIGS. 8–10, the retainer cap 270 includes a central body 272 and a collar 274 attached to an upper portion of the body 272, forming an annular recess 276 therebetween. The body 272 includes first and second well portions 278, 280 and a depending neck 282 for receiving siphon tube 290. Depending neck 282 is fluidly connected to second well 280 through aperture 283. First well 278 is wider than second well 280, a shoulder 284 being formed therebetween. Shoulder 284 includes a vent aperture 286 passing therethrough.

Collar 274 includes on an outer surface 292 a standard thread 288 for receiving a sealing cap (not shown) having a matching thread. The sealing cap is threaded onto the collar 274 and tightened to prevent spillage of the liquid contents in the reservoir 211 during storage and transport, and is removed prior to attachment of reservoir assembly 210 to nozzle assembly 220. Collar 274 further includes a pair of opposing axial grooves 294 extending from an upper surface 296 of the collar 274 to a partial circumferential groove 298 having a detent 302. Collar 274 further includes a key slot 304 adjacent to recess 276.

Figure 11:
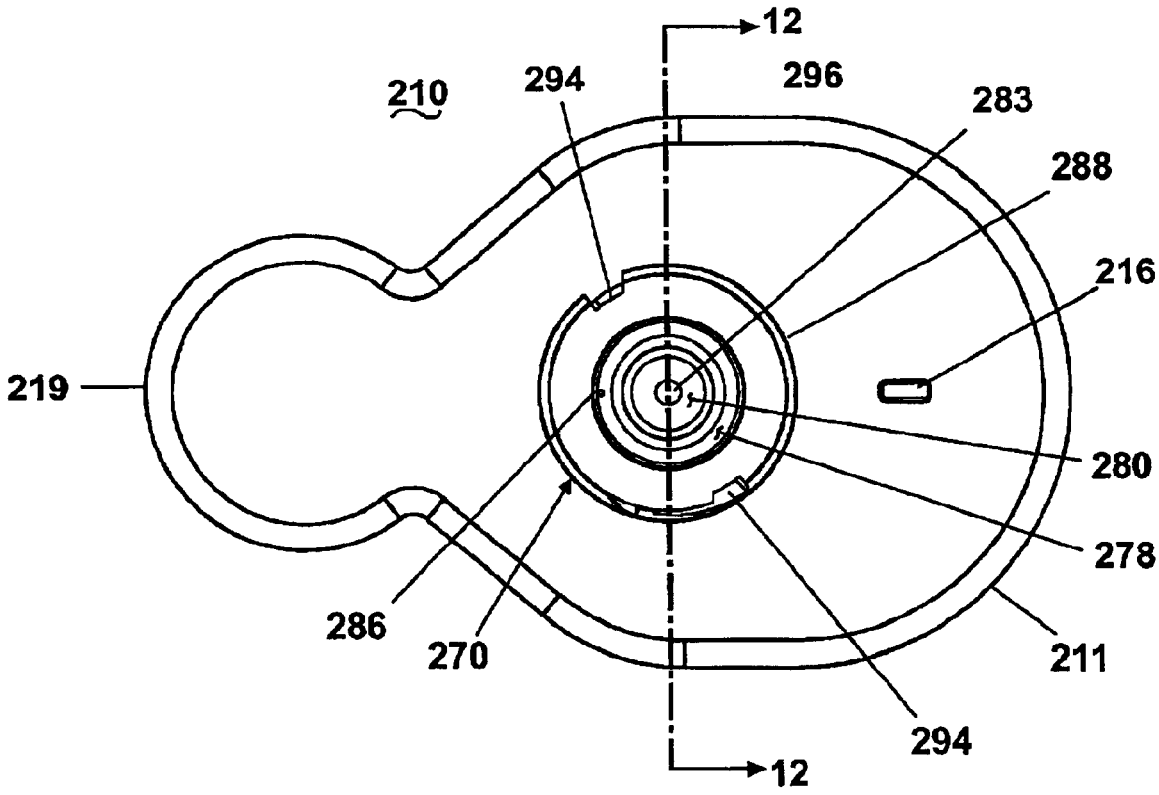
FIG. 11 is a top view of the solution reservoir assembly with installed retainer cap of FIGS. 4–10.
Figure 12:
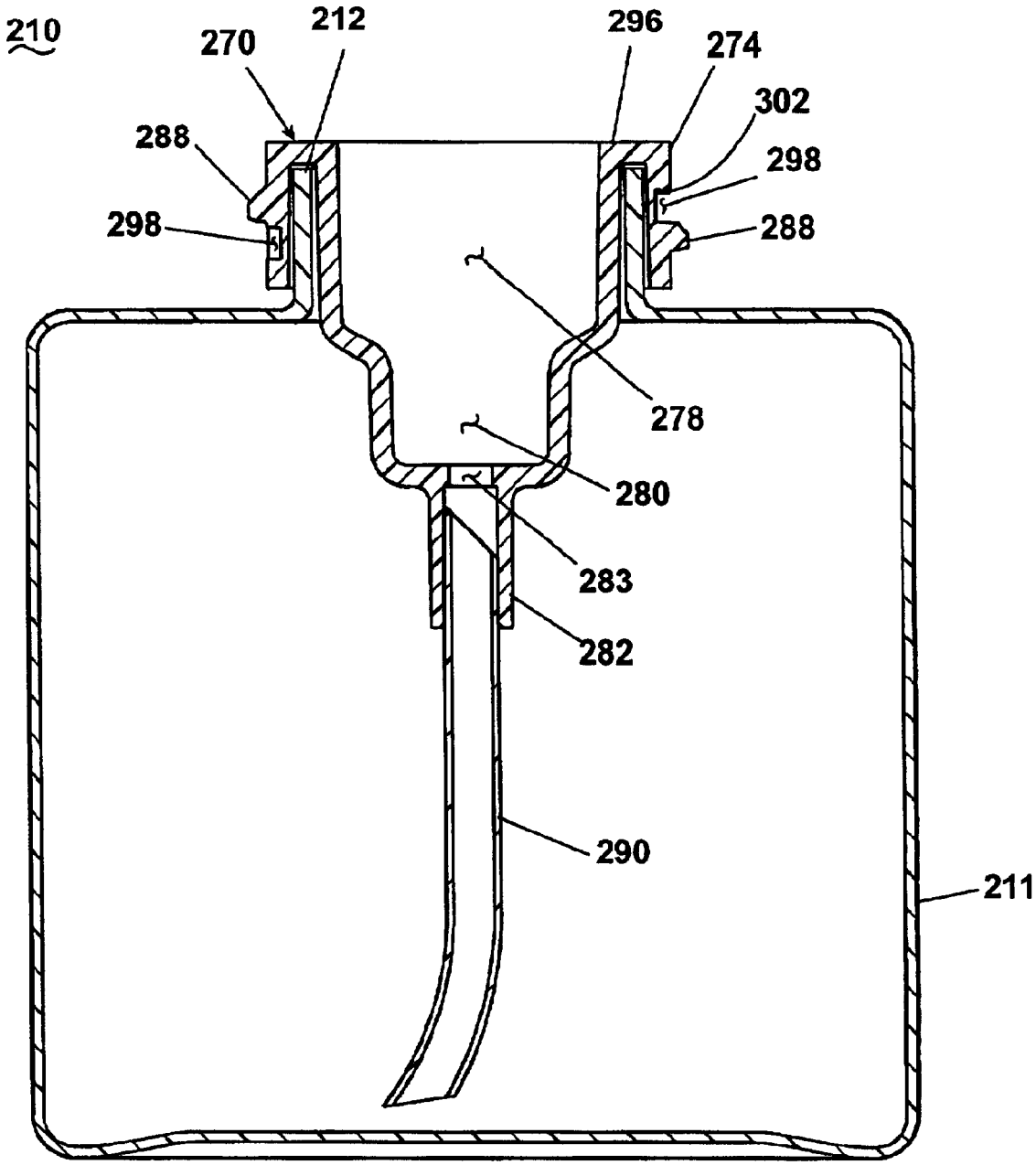
FIG. 12 is a cross-sectional view taken through line 12—12 of FIG. 11.

Referring now to FIGS. 11–12, retainer cap 270 is joined to siphon tube 290 and inserted over neck 212 of solution reservoir 211. Retainer cap 270 is bonded to solution reservoir 211. Retainer cap 270 is installed on solution reservoir 211 in a specific orientation, facilitated by the interaction of key 214 on solution reservoir neck 212 (FIG. 7) and key slot 304 on retainer cap 270 (FIG. 9).

Figure 13:
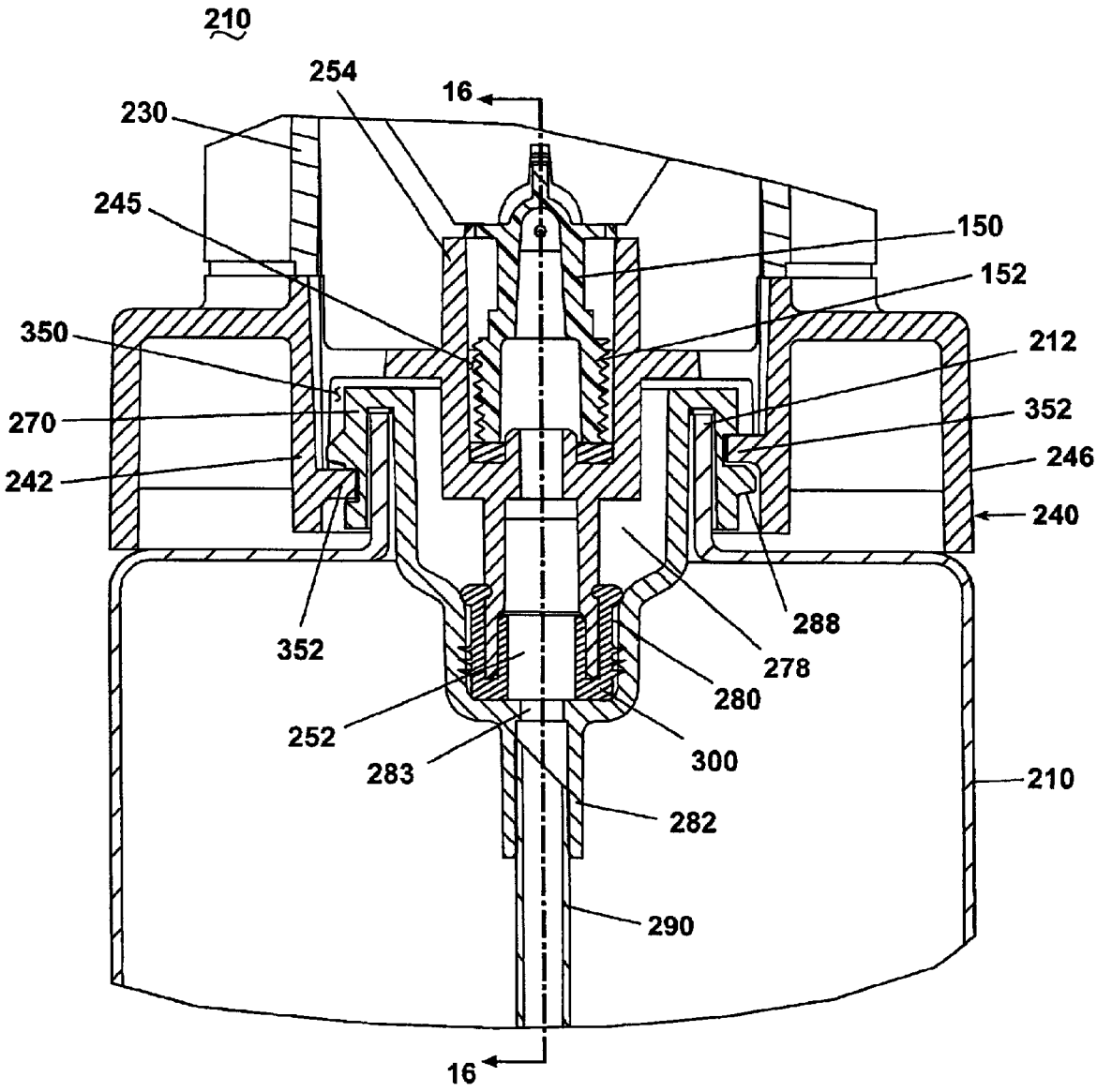
FIG. 13 is an enlarged cross-sectional view of the solution reservoir assembly of FIG. 12 assembled to the nozzle assembly of FIGS. 4–5.
Figure 14:
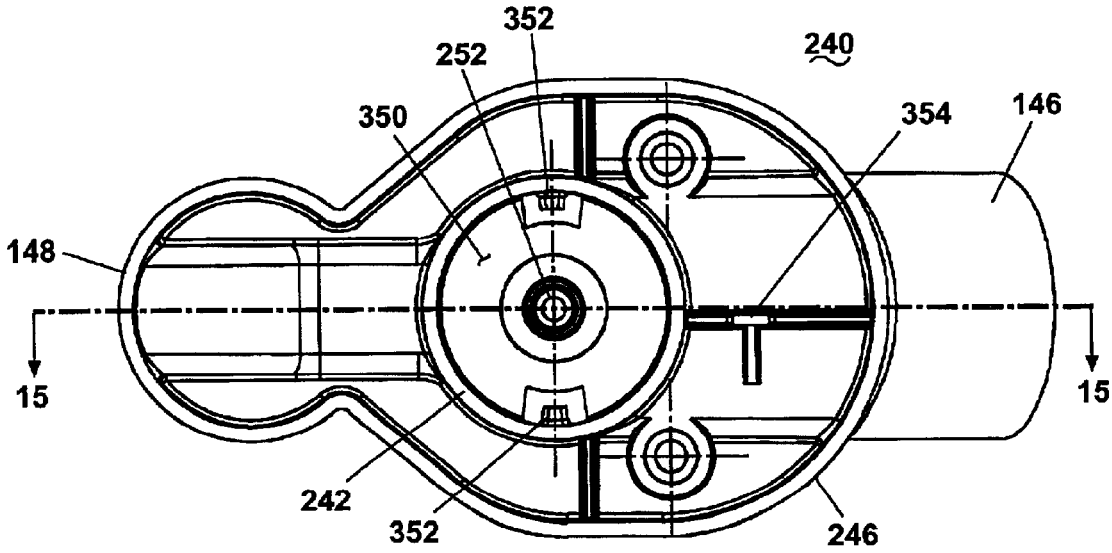
FIG. 14 is a bottom view of the nozzle assembly of FIGS. 4–5.
Figure 15:
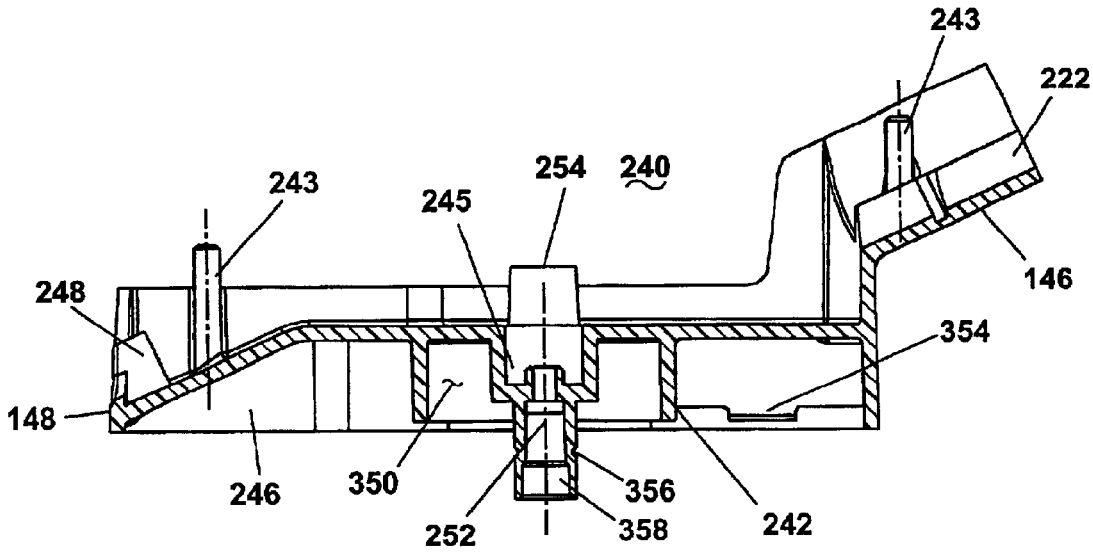
FIG. 15 is a cross-sectional view of a lower portion of the nozzle assembly taken through line 15—15 of FIG. 14.
Figure 16:
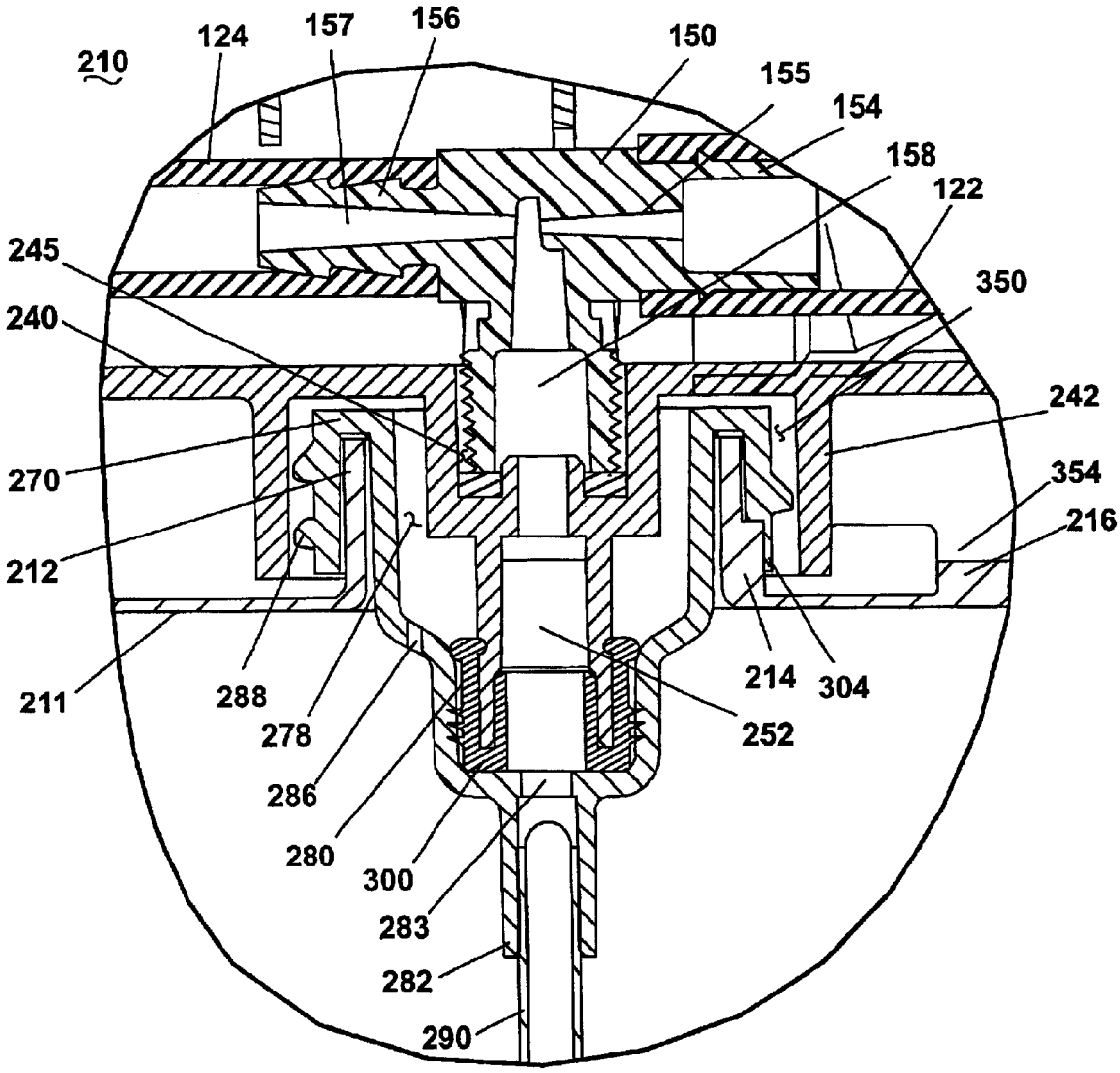
FIG. 16 is a partial cross-sectional view taken through line 16—16 of FIG. 13.
Figure 17:
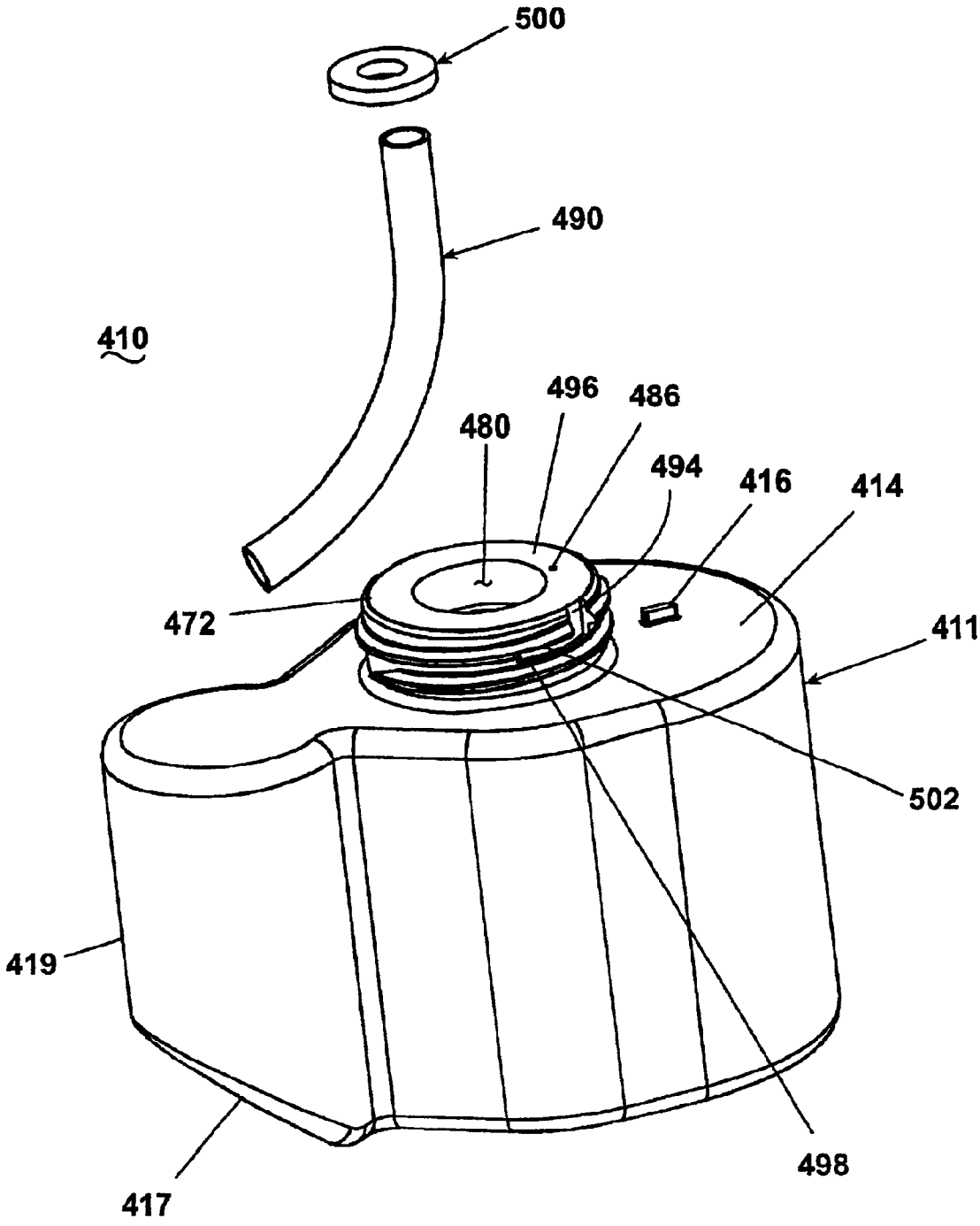
FIG. 17 is a perspective view of a solution reservoir assembly according to a third embodiment of the invention.

Referring now to FIGS. 14–15, the lower housing 240 of the nozzle assembly 220 includes a venturi well 245 for receiving the solution suction fitting of a venturi (see FIGS. 3, 13, 16) for fluidly and sealingly connecting the venturi 150 to a solution suction conduit 252. The venturi 150 is further supported by a venturi cradle 254. Lower housing 240 includes a number of alignment bosses 243 for aligning lower housing 240 with upper housing 230. Dispensing nozzle end 248 is configured to receive dispensing nozzle 160. Solution supply tube groove 222 is configured to receive solution supply cube 122. The solution suction conduit 252 depends from lower housing 240. Lower housing 240 further includes a depending skirt 242 forming an annular recess 350 between skirt 242 and solution suction conduit 252 on the lower face of lower housing 240. Annular recess 350 is configured to receive retainer cap 270 of the solution reservoir assembly 210, so that the solution suction conduit 252 is received in second well 280 and venturi well 245 is received in first well 278. Lower housing 240 further comprises a pair of opposing radial projections 352 projecting inwardly from skirt 242 and adapted to be axially received in grooves 294 of retainer cap 270, such that upon full insertion of retainer cap 270 into annular recess 350, projections 352 are fully engaged in grooves 294 such that rotation of lower housing 240 with respect to retainer cap 270 will direct projections 352 into circumferential grooves 298. Lower housing 240 further comprises an over-rotation stop 354 having a face parallel to and offset from a longitudinal centerline of lower housing 240. Over-rotation stop 354 is positioned to align with over-rotation projection 216 to limit the amount of rotation of the solution reservoir 210 with respect to the nozzle assembly 220.

Solution suction conduit 252 includes on an outer surface thereof an annular groove 356 and inner recess portion 358 for receiving a retaining seal 300 on the end of suction conduit 252. Referring to FIG. 13, seal 300 forms a sealed fluid connection between aperture 283 of retainer cap 270 and solution suction conduit 252. Siphon tube 290, received in neck 282 of retainer cap 270, is therefore in fluid communication with venturi 150 through solution suction conduit 252 and aperture 283.

Referring now to FIGS. 13–16, the nozzle assembly 220 is mounted to the solution reservoir assembly 210 by lowering the nozzle assembly 220 over the solution reservoir assembly 210 with the annular recess 350 centered over the retainer cap 270 and the solution suction conduit 252 over the second well 280 of the retainer cap 270. As the nozzle assembly 220 is lowered onto the solution reservoir assembly 210, the solution suction conduit 252 with attached seal 300 enters the second well 280 in a sealing fashion. The projections 352 are aligned over the axial grooves 294 until the projections 352 reach the circumferential grooves 298. A relative rotation of the nozzle assembly 220 with respect to the solution reservoir assembly 210 of approximately 40° will direct the projections 352 into the circumferential grooves 298 past detents 302 until projections 352 reach the end of the circumferential grooves 298. Nozzle assembly 220 is further prevented from rotating past alignment with the solution reservoir assembly 210 by over-rotation stop 354 abutting over-rotation projection 216. In the preferred embodiment shown, each of the axial grooves 294 is different in length so that the circumferential grooves 298 are at different distances from the top of retainer cap 270. Projections 352 are likewise placed at different elevations within annular recess 350 to each align with one of the circumferential grooves 298, thereby preventing incorrect installation of the solution reservoir assembly 210 onto the nozzle assembly 220. Nozzle assembly 220 and reservoir assembly 210 are configured so that when assembled they present a continuous exterior surface, as a perimeter skirt 246 depends from lower housing 240 to closely conform to an upper edge of reservoir 211.

With the solution reservoir assembly 210 assembled to the nozzle assembly 220, venturi 150 is fluidly connected to the interior of solution reservoir 211 through siphon tube 290 and suction conduit 252. A fluid is supplied to venturi intake port 155 from supply tube 122 fluidly connected to supply tube fitting 154. As the fluid passes through the venturi 150, suction is generated in suction channel 158 and solution suction conduit 252, thereby drawing fluid through siphon tube 290 from solution reservoir 211. The mixture of fluids is expelled from venturi 150 at output port 157 through nozzle supply tube 124 fluidly connected to nozzle supply tube fitting 156.

A vent aperture 286 passes through the shoulder defined between first well 278 and second well 280, fluidly connecting the interior of solution reservoir 211 with first well 278. First well 278 is further fluidly open to the atmosphere through gaps found between retainer cap 270 and annular recess 350. The interior of solution reservoir 211 is therefore fluidly connected to the atmosphere, so that a vacuum is not created in solution reservoir 211 as fluid is drawn by siphon 150. It is further anticipated that a notch can be provided in an upper portion of retainer cap 270 to allow a greater flow of air at atmosphere pressure to the vent aperture 286 to prevent formation of a vacuum inside solution reservoir 211.

FIGS. 17–22 disclose a third embodiment of the solution spray assembly 410 according to the invention. The solution reservoir assembly 410 comprises a unitary blow-molded solution reservoir 411 having an upper surface 414 and a front face 419 having a truncated lower portion 417. A reservoir neck 412 projects upwardly from upper surface 414. Solution reservoir 411 is integrally molded with solution reservoir neck 412. The exterior of solution reservoir neck 412 is molded to include standard threads 488 for receiving a cap for sealing the reservoir assembly 410 during storage and transport. The exterior of solution reservoir neck 412 is further molded to include axial grooves 494, circumferential grooves 498, and detent 502, analogous to the axial grooves 294, circumferential grooves 498 and detent 302 as described above with reference to FIGS. 8–10 depicting retainer cap 270. Reservoir neck 412 further comprises an integrally formed insert 472 having an upper annular wall 496 flush with the upper end of neck 412. Annular wall 496 extends inwardly from neck 412 to a depending proximately cylindrical wall 474 that forms a well 480 with a lower annular wall 476. Insert 472 includes a vent aperture 486 passing through annular wall 496 to the interior of solution reservoir 411. Solution reservoir 411 further includes an over-rotation projection 416 projecting upwardly from upper surface 414 along a longitudinal axis of reservoir 411.

Figure 18:
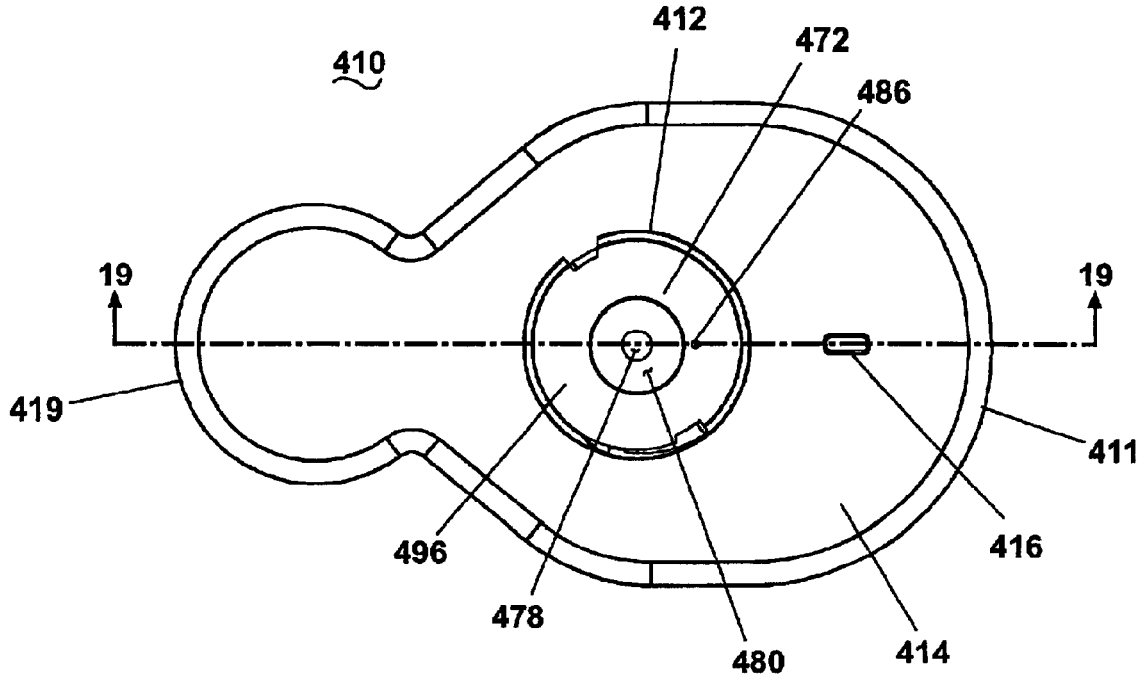
FIG. 18 is a plan view of the solution reservoir of FIG. 17.
Figure 19:
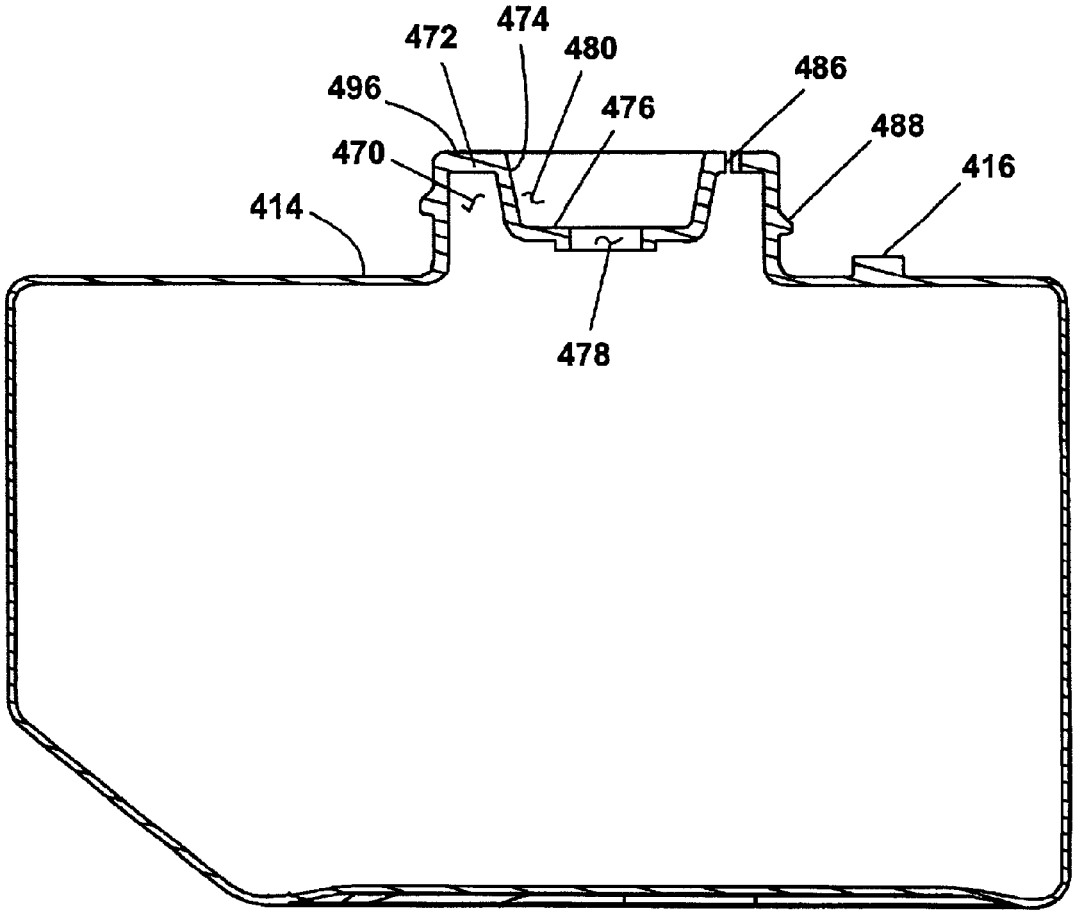
FIG. 19 is a cross-sectional view taken through line 19—19 of FIG. 18.
Figure 20:
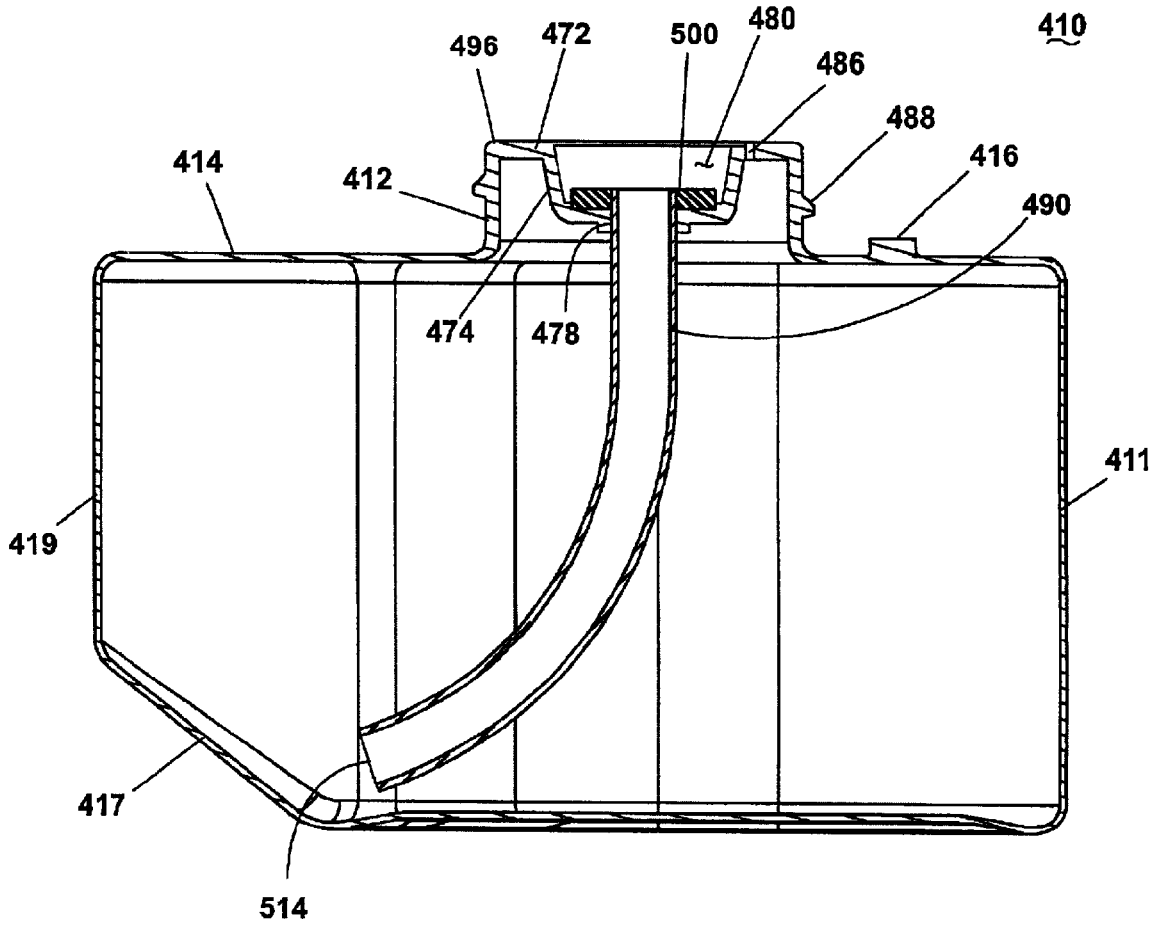
FIG. 20 is the cross-sectional view of FIG. 19 with a seal and siphon tube installed in the reservoir.

Referring to FIGS. 18–20, the interior of solution reservoir neck 412 comprises a solution reservoir neck channel 470. Channel 470 is covered at the upper end of reservoir neck 412 by insert 472, which, in the preferred embodiment, is integrally molded with reservoir neck 412. Insert 472 includes upper annular wall 496, depending cylindrical wall 474, lower annular wall 476, and an aperture 478 in lower annular surface 476. Upper annular surface 496 is configured for alignment with the top of solution reservoir neck 412, with depending cylindrical wall 474 depending into channel 470. Depending cylindrical wall 474 and lower annular wall 476 define well 480, centered in solution reservoir neck 412. Aperture 478 fluidly connects well 480 with the interior of solution reservoir 411. Insert 472 further includes vent aperture 486 in upper annular wall 496 fluidly connecting the interior of solution reservoir 411 to atmosphere.

Figure 21:
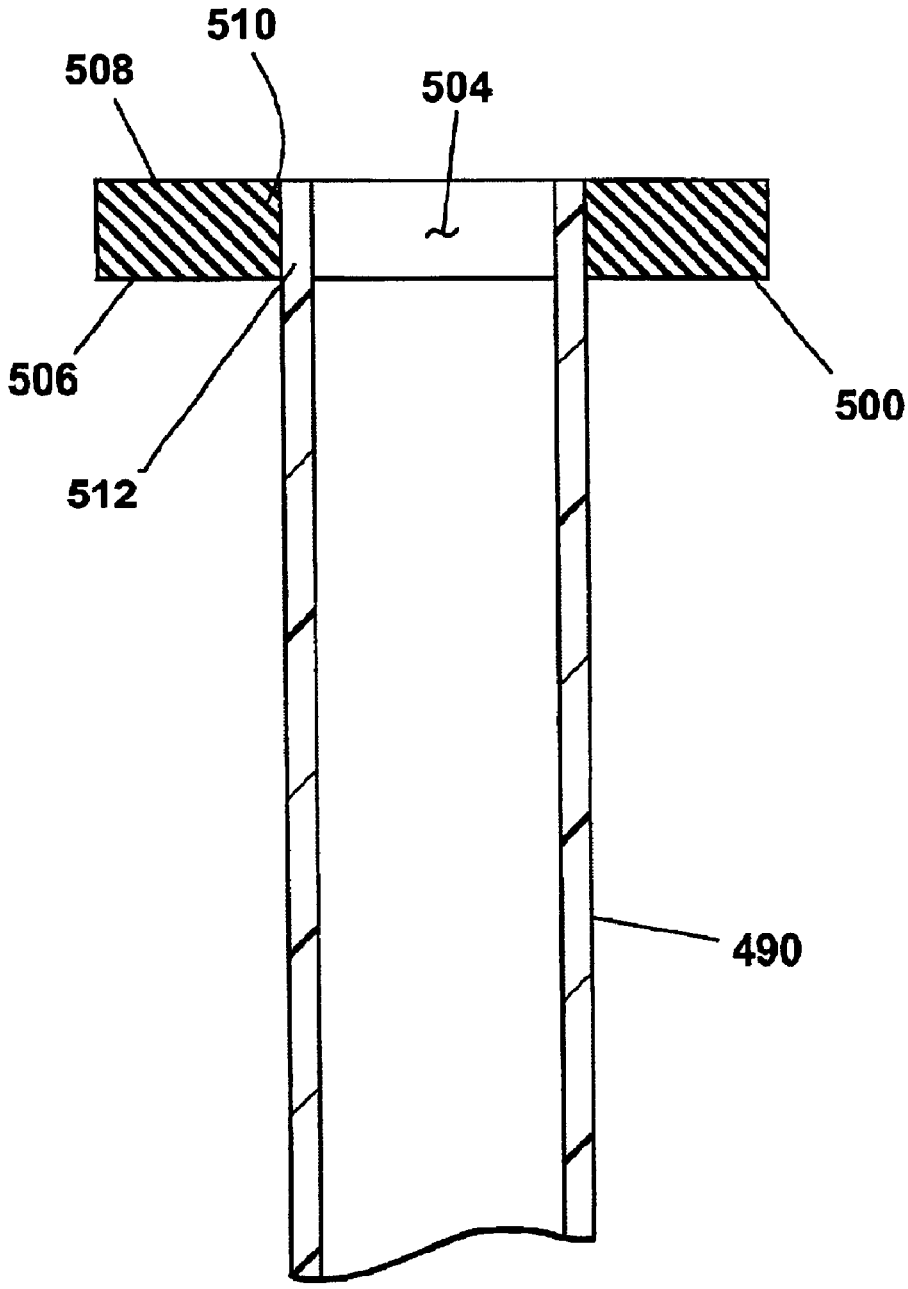
FIG. 21 is an enlarged cross-sectional view of the seal and siphon tube of FIG. 20.

Referring now to FIGS. 20–21, a siphon tube 490 has a first end 512 and a second end 514. Annular seal 500 has a lower surface 506, an upper surface 508, and a central passage 504 having a perimeter wall 510. The first end 512 of siphon tube 490 cooperates with perimeter wall 510 of seal 500 to retain siphon tube 490 within central aperture 504 of seal 500. The assembly comprising siphon tube 490 and seal 500 is inserted into well 480, with siphon tube 490 passing through aperture 478 and into reservoir 411 such that second end 514 of siphon tube 490 is arranged proximate truncated lower portion 417 of reservoir 411. Seal 500 is inserted into well 480 such that lower surface 506 sealingly contacts lower annular wall 476 of well 480. Preferably, an adhesive secures seal 500 to lower annular wall 476 of well 480 to prevent removal. Aperture 478 is thus sealed, fluidly isolating well 480 from the interior of reservoir 411 except through siphon tube 490.

Solution reservoir assembly 410 can now be pre-filled with a solution, a standard cap applied to neck 412, and the sealed assembly 410 transported to the end user. In a further embodiment of the manufacturing process, the solution reservoir 411 can be pre-filled with a solution prior to the insertion of the siphon tube 490 and seal 500.

Figure 22:
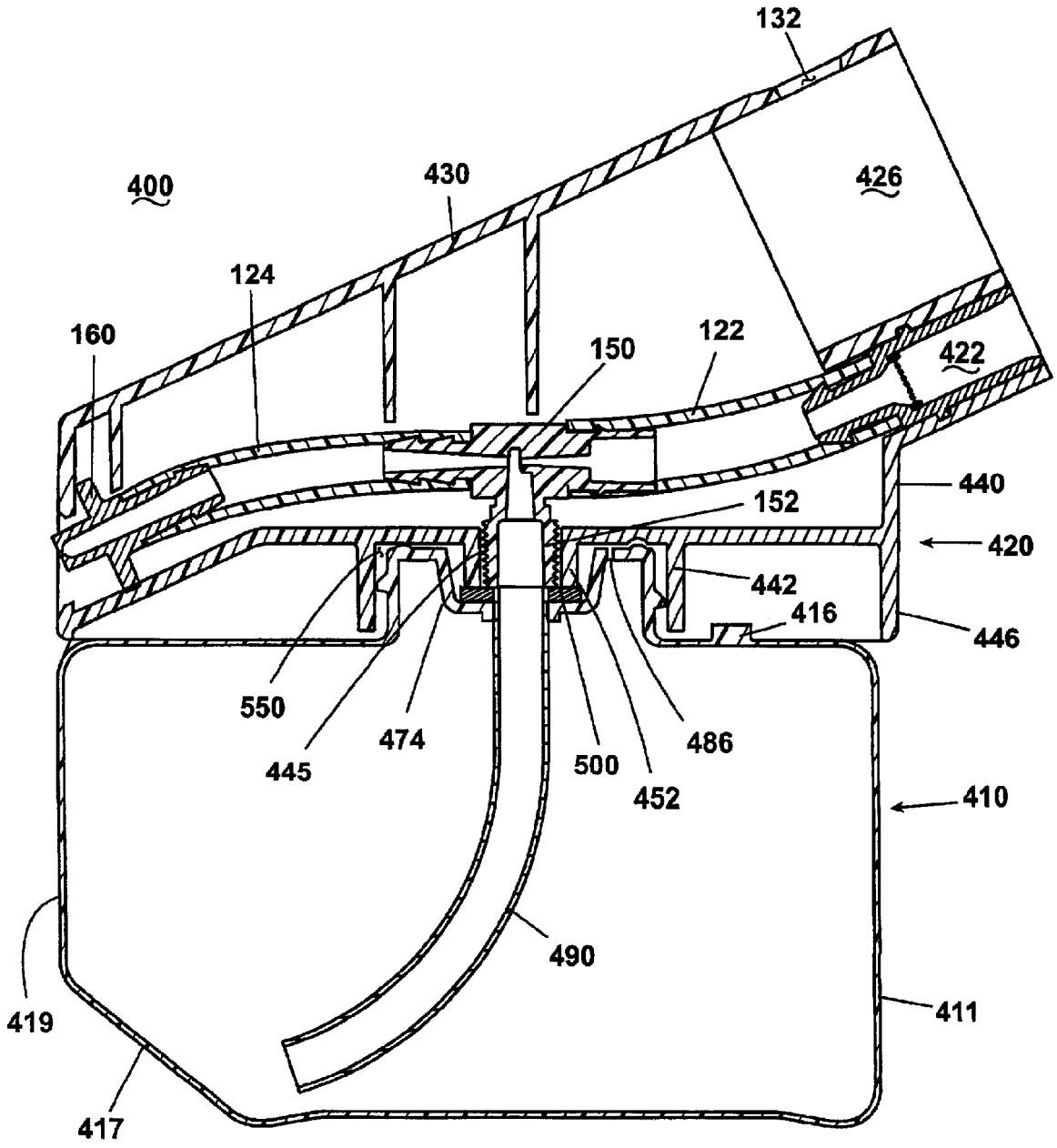
FIG. 22 is a cross-sectional view of a nozzle assembly mounted on the solution reservoir of FIGS. 17–21 according to the third embodiment of the invention.

When the user is ready to employ the solution reservoir assembly 410, the user removes the standard cap from the reservoir neck 412 and attaches the assembly 410 to a nozzle assembly 420, as shown in FIG. 22. Lower housing 440 of nozzle assembly 420 includes a skirt portion 446 for matching the outer contour of reservoir 411, as in the second embodiment. Lower housing 440 further includes depending concentric cylindrical walls 442, 452, arranged so that cyclindrical wall 452 is lowered into well 480 as nozzle assembly 420 is assembled onto reservoir assembly 420. Simultaneously, cylindrical wall 442 surrounds reservoir neck 412 so that reservoir neck 412 enters a cavity 550 defined between walls 442, 452. Cylindrical wall 442 includes inwardly directed projections (not shown) for engaging axial and circumferential grooves 494, 498 of the reservoir neck 412, as in the second embodiment, to prevent displacement of the nozzle assembly 420 from reservoir neck 412.

As nozzle assembly 420 is lowered onto reservoir neck 412, cylindrical wall 452 descends into well 480 until it abuts upper surface 508 of seal 500. Venturi 150 is mounted within nozzle assembly 420 so that venturi solution suction fitting 152 depends within a cavity 445 formed by cylindrical wall 452 and is flush with the bottom edge thereof. The venturi solution suction fitting 152 therefore abuts upper surface 508 of seal 500 to form a fluid-tight seal with siphon tube 490 and the solution in the solution reservoir 411. As the nozzle assembly draws solution from the solution reservoir 411, the interior of solution reservoir 411 is vented through vent aperture 486 to prevent creation of reduced pressure within solution reservoir 411. The nozzle assembly also includes openings 422, 426 for connecting the spray assembly 400 to the deep cleaner 10. The nozzle assembly otherwise functions substantially as described in the previous embodiments illustrated in FIGS. 1–16.

The operation of the spray applicator 100, 200, 400 in combination with the upright deep cleaner 10 (also known as an extractor) will now be further discussed. The spray applicator 100, 200, 400 is attached to the above-floor cleaning hose 16, so that it is fluidly connected to at least the fluid delivery conduit of the above-floor cleaning hose 16. If the upright deep cleaner 10 is supplying only water, the reservoir of the spray applicator 100, 200, 400 can be filled with a surface treatment for mixing with the supplied water. In an alternative method of use, a clean solution tank on the upright deep cleaner 10 can be filled with a pre-mixed surface treatment and the reservoir of the spray applicator 100, 200, 400 need not be used.

The upright deep cleaner 10 is energized to provide a pressurized flow of water or solution through the above-floor cleaning hose 16, or specifically, the fluid delivery conduit of the above-floor cleaning hose 16. The above-floor handle 18 of the upright deep cleaner 10 generally includes a dispensing actuator mechanism for the operator to initiate fluid dispensing at the above-floor cleaning attachment 16. This actuator can take the form of a spring-biased clamp that is releasable by a trigger-like mechanism on the handle 18. Therefore, the spray applicator 100, 200, 400 according to the invention does not require an additional actuation mechanism in the form of a water supply cutoff.

Upon actuation of the liquid supply from the deep cleaner 10, the liquid flowing through the water supply tube 122 and venturi 150 creates a low-pressure region in the venturi 150. The low-pressure region within the venturi 150 draws the surface treatment into the venturi 150 from the solution reservoir of the spray applicator 100, 200, 400. The surface treatment is then mixed in the venturi valve 150 with the water being supplied through the water supply tube 122 for dispensing through the nozzle supply tube 124 and dispensing nozzle 160 for application to a surface being treated.

Each of the embodiments of the spray applicator 100, 200, 400 disclosed includes an opening for receiving the suction conduit of the above-floor cleaning hose 16. When attached to an upright deep cleaner 10 having a suction source that is activated whenever the deep cleaner is activated, the spray applicator 100, 200, 400 must provide venting for the suction conduit to prevent the suction source from overheating. In the alternative, a further embodiment of a spray applicator (not shown) can connect to the fluid supply conduit without engaging the suction conduit of the above-floor cleaning hose 16. The spray applicator 100, 200, 400 is also adapted to be used with an upright deep cleaner 10 having a suction source operable independently of a solution pump.

Figure 23:
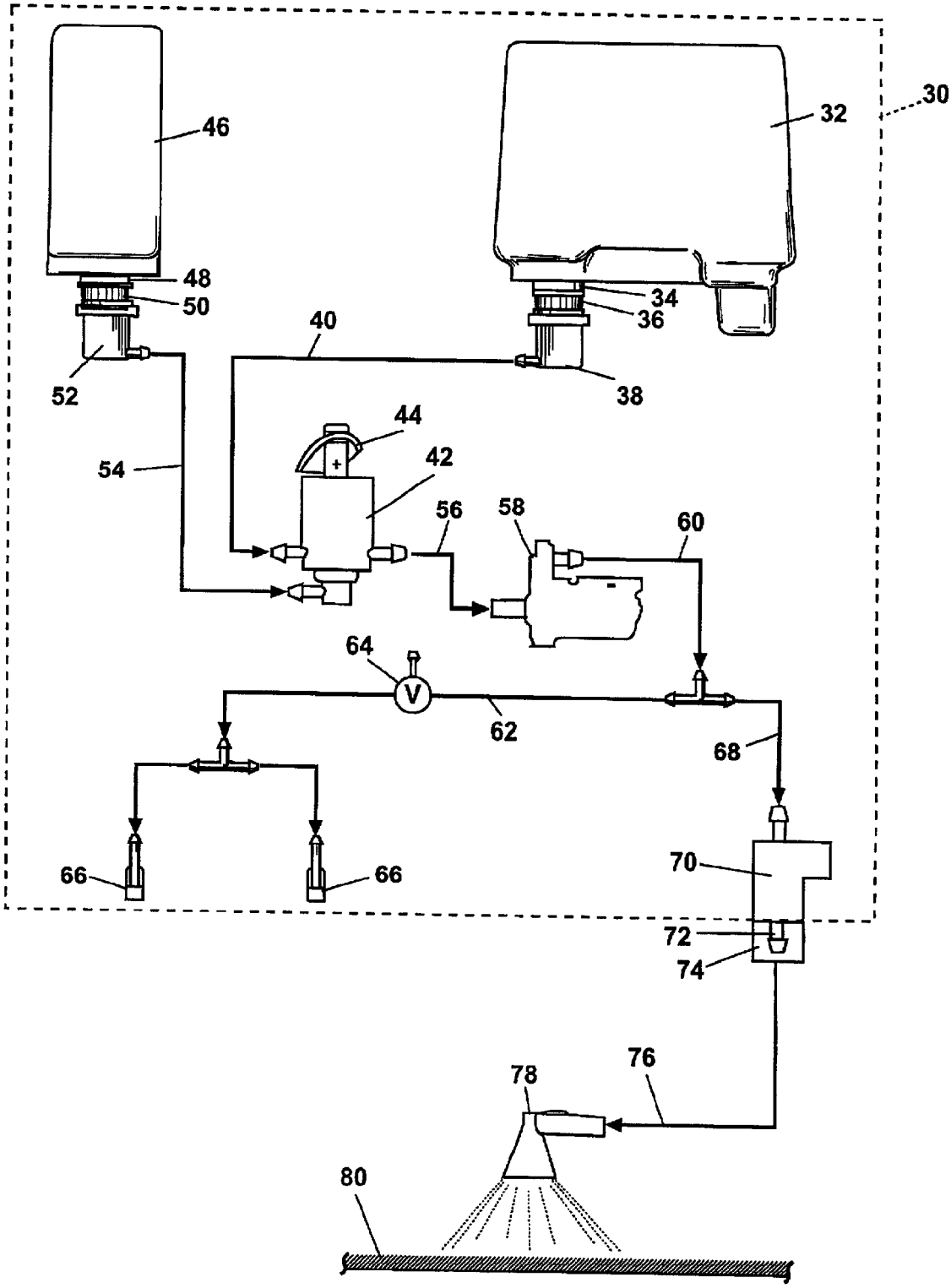
FIG. 23 is a schematic view of yet another embodiment of the invention.

Referring now to FIG. 23, there is shown a schematic representation of a solution delivery system which forms a part of an upright water extraction cleaning machine 30 which is disclosed in more detail in U.S. Pat. No. 6,041,472, which is incorporated herewith in its entirety by reference. FIG. 23 shows only the solution distribution portion of that water extraction cleaning machine although the water extraction cleaning machine 30 has all of the features disclosed in the U.S. Pat. No. 6,041,472.

The solution distribution system comprises a clean water tank 32 having a neck 34 and a valve 36 which dispenses water from the water tank 32 into a receptacle 38 when the clean water tank 32 is mounted on the extraction cleaning machine 30 in a receptacle 38. A water line 40 extends from the receptacle 38 to an inlet of a mixing valve 42. The mixing valve has a knob 44 which adjusts the mixing of components in the mixing valve 42 in a manner disclosed in the U.S. Pat. No. 6,041,472.

A solution tank 46 has a neck 48 and a valve 50 which releases solution in the solution tank 46 to a receptacle 52 when the solution tank is mounted to the receptacle in the extraction cleaning machine 30. Solution passes from the receptacle 52 through solution line 54 to an input port to the mixing valve 42. The knob 44 controls the relative amount of clean water in line 40 mixed with solution in line 54 in the mixing valve 42. The output from the mixing valve 42 passes through line 56 to a pump 58 and from pump 58 through line 60, branch line 62, through valve 64 to spray nozzle 66 which applies the water/solution mixture to a floor surface. The valve 64 is controlled by a trigger (not shown) in the handle of the upright extraction cleaning machine 30.

A branch line 68 is connected to a spring-biased valve 70 which has a fitting 72. The foregoing is a description of the upright water extraction cleaning machine as disclosed in the U.S. Pat. No. 6,041,472. According to the invention, a connector 74 is mounted to the fitting 72 to open the valve 70. The connector 74 is connected to a spray wand 78 through a tube 76. The spray wand 78 is adapted to spray the solution onto a carpet 80.

According to the invention, the solution tank 46 has a protectant solution therein. The protectant solution can be a stain-resistant composition, such as Scotchgard™ protectant, a mildew-resistant composition or can alternatively be a miticide solution. The protectant solution is mixed with clean water in the mixing valve 42 and pumped through pump 58 through the valve 70, through line 76 and to the spray wand 78. Alternatively, the protectant solution can be mixed with water and placed directly in the clean water tank 72 and passed through the mixing valve which is set to close off the input port from solution line 54. The mixture of water and protectant can then pass undiluted through line 56, pump 58, line 60, line 68, through valve 70 and to the spray wand 78. In an alternate embodiment, a liquid miticide composition can be added to the solution tank 46 and mixed with water and protectant in the clean water tank 32 by means of the mixing valve 42 and passed to the spray wand 78 for spraying on the carpet.

While the invention has been specifically described in connection with certain specific embodiments thereof, it is to be understood that this is by way of illustration and not of limitation. Reasonable variation and modification are possible within the scope of the foregoing description and drawings without departing from the spirit of the invention.

What is claimed is:

1. A portable surface cleaning apparatus, comprising:

a base housing adapted for movement along a surface to be cleaned;

an upright handle pivotally mounted to the base housing;

a liquid dispensing system mounted at least in part to the base housing and comprising:

a first liquid dispenser associated with the base housing for applying liquid to a surface to be cleaned;

a liquid supply tank for holding a supply of cleaning liquid;

a first liquid supply conduit fluidly connected to the liquid supply tank and to the first liquid dispenser for supplying liquid to the first liquid dispenser;

a second liquid dispenser separate from the base housing and including a spray nozzle for dispensing liquid onto the surface to be cleaned; and a second liquid supply conduit fluidly connected to the liquid supply tank and to the second liquid dispenser for supplying liquid to the second liquid dispenser;

a cleaning fluid pump for delivering cleaning liquid from the liquid supply tank at least in part to the second liquid dispenser;

a liquid recovery system comprising:

a recovery tank mounted on the base housing and having a liquid recovery chamber for holding recovered liquid;

a suction nozzle associated with the base housing and adapted to draw dirty liquid from the surface to be cleaned;

a working air conduit extending between the recovery tank and the suction nozzle;

an above-floor hose connected at one end to the recovery tank and having an open end for alternatively recovering liquid from the open end through the above-floor hose, the above-floor hose carrying the second liquid supply conduit and mounting the second liquid dispenser at the open end therof;

a vacuum source in fluid communication with the liquid recovery chamber for generating a flow of working air from the nozzle through the working air conduit, or alternatively from the open end of the above-floor hose, and through the liquid recovery chamber to thereby draw dirty liquid from the surface to be cleaned through the nozzle and working air conduit, or from the open end of the above-floor hose and into the liquid recovery chamber to thereby recover the dirty liquid from the surface to be cleaned;

the improvement comprising:

a fluid reservoir mounted to the second liquid dispenser for dispensing a fluid onto the surface; and a fluid reservoir pump mounted to the second liquid dispenser for drawing fluid from the reservoir and for spraying the fluid onto the surface along with the fluid from the liquid supply tank.

2. A portable surface cleaning apparatus according to claim 1 wherein the fluid reservoir pump is an aspirator.

3. A portable surface cleaning apparatus according to claim 2 wherein the second liquid dispenser is without a suction nozzle opening.

4. A portable surface cleaning apparatus according to claim 2 wherein the second liquid dispenser has a vent opening for venting suction in the hose to the atmosphere.

5. A portable surface cleaning apparatus according to claim 4 wherein the second liquid dispenser and the reservoir have a quick connect mechanism for removably mounting the reservoir to the second liquid dispenser.

6. A portable surface cleaning apparatus according to claim 5 wherein the quick connect mechanism includes an open neck on an upper portion of the reservoir.

7. A portable surface cleaning apparatus according to claim 6 and further comprising a cap for mounting to the open neck of the reservoir when the reservoir is removed from the second liquid dispenser for sealing the reservoir when the reservoir is removed from the second liquid dispenser.

8. A portable surface cleaning apparatus according to claim 7 wherein the neck is threaded and the cap is threaded onto the neck.

9. A portable surface cleaning apparatus according to claim 8 wherein the reservoir is vented through the threads on the neck.

10. A portable surface cleaning apparatus according to claim 8 wherein the quick connect is a bayonet connection.

11. A portable surface cleaning apparatus according to claim 1 wherein the second liquid dispenser has a vent opening for venting suction in the hose to the atmosphere.

12. A portable surface cleaning apparatus according to claim 1 wherein the second liquid dispenser and the reservoir have a quick connect mechanism for removably mounting the reservoir to the second liquid dispenser.

13. A portable surface cleaning apparatus according to claim 12 wherein the quick connect mechanism includes an open neck on an upper portion of the reservoir.

14. A portable surface cleaning apparatus according to claim 13 and further comprising a cap for mounting to the open neck of the reservoir when the reservoir is removed from the second liquid dispenser for sealing the reservoir when the reservoir is removed from the second liquid dispenser.

15. A portable surface cleaning apparatus according to claim 14 wherein the neck is threaded and the cap is threaded onto the neck.

16. A portable surface cleaning apparatus according to claim 15 wherein the reservoir is vented through the threads on the neck.

17. A portable surface cleaning apparatus according to claim 12 wherein the quick connect mechanism is a bayonet connection.

18. A portable surface cleaning apparatus according to claim 1 and further comprising a body of a liquid surface protectant composition in the reservoir.

19. A portable surface cleaning apparatus according to claim 1 and further comprising a body of a liquid stain repellent composition in the reservoir.

20. A portable surface cleaning apparatus according to claim 1 and further comprising a body of a liquid miticide composition in the reservoir.

21. A portable surface cleaning apparatus according to claim 1 wherein the liquid recovery system further comprises a switch for selectively operating the vacuum source independent of the pump.

22. A portable surface cleaning apparatus according to claim 1 wherein the second liquid dispenser is void of a suction nozzle.

* * * * *

UNITED STATES PATENT AND TRADEMARK OFFICE

CERTIFICATE OF CORRECTION

PATENT NO. : 6,775,880 B2
DATED : August 17, 2004
INVENTOR(S) : Gary A. Kasper et al.

It is certified that error appears in the above-identified patent and that said Letters Patent is hereby corrected as shown below:

Column 14,
Line 21, reads "wherein the quick connect is a bayonet connection."
should read -- wherein the quick connect mechanism is a bayonet connection. --

Signed and Sealed this

Thirtieth Day of November, 2004

JON W. DUDAS
*Director of the United States Patent and Trademark Office*